US012752951B2

(12) United States Patent
Xiao et al.

(10) Patent No.: US 12,752,951 B2
(45) Date of Patent: Oct. 6, 2026

(54) CONVEYING MECHANISM FOR PACKAGING MACHINERY AND PACKAGING MACHINERY

(71) Applicant: CHENGDU MEIJINDI MACHINERY CO., LTD., Sichuan (CN)

(72) Inventors: Renwang Xiao, Chengdu (CN); Xiaowei Yang, Chengdu (CN); Zhuping Zhang, Chengdu (CN)

(73) Assignee: CHENGDU MEIJINDI MACHINERY CO., LTD., Chengdu (CN)

( * ) Notice: Subject to any disclaimer, the term of this patent is extended or adjusted under 35 U.S.C. 154(b) by 0 days.

(21) Appl. No.: 18/826,188

(22) Filed: Sep. 6, 2024

(65) Prior Publication Data

US 2025/0083849 A1 Mar. 13, 2025

(30) Foreign Application Priority Data

Sep. 7, 2023 (CN) ..... 202311154334.X

(51) Int. Cl.
*B65B 43/60* (2006.01)
*B65B 43/46* (2006.01)
(Continued)

(52) U.S. Cl.
CPC ..... *B65B 43/60* (2013.01); *B65B 43/465* (2013.01); *B65B 43/50* (2013.01); *B65B 5/045* (2013.01); *B65B 5/067* (2013.01); *B65B 39/10* (2013.01)

(58) Field of Classification Search
CPC ..... B65B 43/30; B65B 43/50; B65B 43/60; B65B 43/465; B65B 39/145
See application file for complete search history.

(56) References Cited

U.S. PATENT DOCUMENTS 5,182,898 A * 2/1993 Tung ..... B65B 43/465 53/384.1
6,079,541 A * 6/2000 Bercelli ..... B08B 9/426 198/470.1
(Continued)

FOREIGN PATENT DOCUMENTS

CN 206914761 U 1/2018
CN 211167615 U 8/2020
(Continued)

OTHER PUBLICATIONS

Extended European Search Report issued on May 23, 2025 for the European counterpart application No. 24198839.3.

*Primary Examiner* — Joshua G Kotis
(74) *Attorney, Agent, or Firm* — Yue (Robert) Xu; Apex Attorneys at Law, LLP

(57) ABSTRACT

A conveying mechanism for packaging machinery includes a rotation base, a station assembly, and an expansion-retraction driving mechanism. The station assembly is connected to the rotation base and rotates along with the rotation base. The station assembly includes multiple station units for arranging a packaging container, and the expansion-retraction driving mechanism drives the at least two station units to move, to make the station assembly switch between an expanded posture and a retracted posture. With the conveying mechanism for the packaging machinery and the packaging machinery according to the present application, multiple packaging containers can be processed for packaging production at the same time, thereby effectively enhancing the efficiency of the packaging process, reducing a radius of gyration by switching the posture of the station assembly during circulation of the station assembly, improving structural compactness, reducing the occupied volume.

19 Claims, 21 Drawing Sheets

(51) Int. Cl.

| | |
|---|---|
| ***B65B 43/50*** | (2006.01) |
| *B65B 5/04* | (2006.01) |
| *B65B 5/06* | (2006.01) |
| *B65B 39/10* | (2006.01) |

(56) References Cited

U.S. PATENT DOCUMENTS

2004/0011005 A1* 1/2004 Daoust ..... B65B 11/10 53/529
2007/0209907 A1* 9/2007 Furlotti ..... B65B 51/32 198/379
2010/0269458 A1* 10/2010 Veix ..... B65B 43/465 53/570
2013/0036716 A1* 2/2013 Tsutsumi ..... B65B 7/20 53/564
2013/0125508 A1* 5/2013 Honda ..... B65B 39/12 53/268
2013/0192720 A1* 8/2013 Ouellet ..... B65B 5/067 144/24.17
2015/0040519 A1 2/2015 May et al.
2015/0217889 A1* 8/2015 Nakamoto ..... B65G 17/323 198/678.1
2015/0251778 A1* 9/2015 Tachibana ..... B65B 3/003 141/2
2015/0266601 A1 9/2015 Vollenkemper
2017/0100843 A1* 4/2017 Yoshikane ..... B25J 15/0052
2017/0361967 A1* 12/2017 Campagnoli ..... B65B 43/60
2018/0162576 A1* 6/2018 Nakamoto ..... B65G 25/02
2018/0312280 A1* 11/2018 Biondi ..... B65B 57/04
2019/0055041 A1* 2/2019 Castellari ..... B65B 43/10
2019/0217982 A1* 7/2019 Kato ..... B65B 43/46
2020/0189780 A1* 6/2020 Sago ..... B65B 43/465
2020/0317379 A1* 10/2020 Rivola ..... B65B 57/14
2024/0417123 A1* 12/2024 Gressler ..... B65B 59/005

FOREIGN PATENT DOCUMENTS

CN 215362059 U * 12/2021
DE 9304856 U1 * 7/1993 ..... B65B 43/28
DE 202018100593 U1 2/2018
KR 101912464 B1 * 10/2018 ..... B65B 25/00

* cited by examiner

CONVEYING MECHANISM FOR PACKAGING MACHINERY AND PACKAGING MACHINERY

The present application claims the priority to Chinese Patent Application No. 202311154334.X, titled "CONVEYING MECHANISM FOR PACKAGING MACHINERY AND PACKAGING MACHINERY", filed with the China National Intellectual Property Administration on Sep. 7, 2023, the entire disclosure of which is incorporated herein by reference.

FIELD

The present application relates to the technical field of packaging machineries, and in particular to a conveying mechanism for packaging machinery and the packaging machinery.

BACKGROUND

Automatic bag packaging machinery is commonly used packaging equipment. In the automatic bag packaging machinery, a stack of raw packaging bags is placed at a bag storage portion of the machinery. The stack of raw packaging bags is taken out from the bag storage part by a bag taking mechanism one by one. Then, operations such as bag opening, material filling, bag sealing, and bag discharging are performed. Finally, sealed bags that are filled with materials are obtained. Conventional automatic bag packaging machineries have various forms of structures, but all of them are generally of a single circulated conveying structure, that is, only one bag can be opened, filled with materials, sealed, and discharged in sequence at one time. Therefore, the efficiency is low, and the packaging production can hardly be efficient and stable.

SUMMARY

A technical problem to be solved and a technical mission being proposed according to the present application are to improve the conventional technology, to provide a conveying mechanism for packaging machinery and the packaging machinery, to solve the problem that the efficiency of packaging machinery in the conventional technology is relatively low, and the packaging production can hardly be efficient and stable.

To solve the above technical problem, following technical solutions are provided according to the present application.

A conveying mechanism for packaging machinery includes a rotation base, a station assembly, and an expansion-retraction driving mechanism. A rotation driving mechanism is configured to drive the rotation base to rotate intermittently, and the station assembly is connected to the rotation base. The station assembly includes at least two station units for a packaging container to be arranged. The expansion-retraction driving mechanism is configured to drive the at least two station units to move, to make the station assembly switch between an expanded posture and a retracted posture. A radius of gyration of the station assembly in the retracted posture is smaller than a radius of gyration of the station assembly in the expanded posture. With the conveying mechanism for the packaging machinery according to the present application, multiple packaging containers can be processed for the packaging production at the same time. Driven by the rotation base, the station assembly efficiently switches between different preset workstations, which effectively enhances the efficiency of processing operations, so as to realize efficient and stable packaging production. Moreover, the posture of the station assembly can switch to decrease the radius of gyration of the entire station assembly when the station assembly rotates along with the rotation base. In this way, the structure becomes more compact, and the overall volume occupied by the machinery is reduced while the production of packaging is improved. A moment of inertia is also effectively reduced as the radius of gyration is decreased during rotation. Thus, it becomes easier to accelerate the rotation and increase a rotation speed. That is, the station assembly can switch between each preset workstation more efficiently, and it takes less time for the station assembly to circulate between the preset workstations for different packaging processes, thereby effectively increasing the operation speed of the packaging machinery, and better improving the efficiency of the packaging production.

Further, when the station assembly is in the expanded posture, the at least two station units of the station assembly are linearly arranged along a tangential direction of a circumferential direction of rotation of the rotation base, to facilitate structural design of an operating mechanism, and facilitate the packaging operation processes at the multiple stations in parallel. When the station assembly is in the retracted posture, the at least two station units of the station assembly are arranged along the circumferential direction of the rotation of the rotation base, to effectively decrease the radius of gyration to reduce the space occupied by the conveying mechanism for the packaging machinery, thereby reducing an overall size of the packaging machinery. Moreover, when the station assembly is in the retracted posture, the station units are more evenly distributed along the circumferential direction of the rotation base, which makes the rotation more stable, and increases smoothness of operation of the machinery.

Further, the at least two station units of the station assembly are connected in sequence, every two adjacent station units are hingedly connected, and the expansion-retraction driving mechanism is configured to drive the two adjacent station units to deflect with respect to each other, to make the station assembly switch between the expanded posture and the retracted posture.

Or, the at least two station units of the station assembly are connected in sequence, every two adjacent station units are connected in a slidable manner, and are slidable with respect to each other along a radial direction of the rotation base, and the expansion-retraction driving mechanism is configured to drive the two adjacent station units to slide with respect to each other, to make the station assembly switch between the expanded posture and the retracted posture. The station units of the station assembly are connected into a whole in a relatively movable manner. The station assembly can not only be driven by the rotation base to be conveyed between the different preset workstations, but also switch the posture according to various needs. In this way, multiple packaging operations can be easily performed at the same time during each packaging process. Moreover, the radius of gyration and the moment of inertia are ensured to be relatively small when the rotation base drives the station assembly to rotate, thereby improving the structural compactness, reducing the occupied volume, increasing the operation speed, and better raising the packaging production.

Further, when the number of the at least two station units of the station assembly is even, two of the at least two station units right in the middle are connected to the rotation base in a movable manner. When the number of the at least two station units of the station assembly is odd, one of the at least two station units right in the middle is fixedly connected to the rotation base. In this way, equivalently, a middle portion of the station assembly is connected to the rotation base, such that the station units are more evenly distributed on the rotation base, which helps the entire conveying mechanism for the packaging machinery operate more smoothly, thereby ensuing operation stability.

Further, the expansion-retraction driving mechanism includes a driving component, a connecting rod assembly, and a slider. The slider is connected to the rotation base in a slidable manner, and is configured to slide along a radial direction of a circumference of the rotation of the rotation base. The slider is connected to the at least two station units of the station assembly through the connecting rod assembly, and the driving component is configured to drive the slider to move along the radial direction of the circumference of the rotation of the rotation base, to make the station assembly switch between the expanded posture and the retracted posture. In this way, the structure is simple and easy to implement, leading to a good interconnection performance. The slider is driven to slide to drive the station units to move in an interconnected manner, and positions of the two adjacent station units relatively vary to change the posture of the station assembly, such that the station assembly finally switches between the expanded posture and the retracted posture.

Further, the driving component includes a cam guide component, and the slider is connected to the cam guide component in a slidable manner. The structure is simple and easy to implement, while an additional power component is not needed. As the rotation base is driven by the rotation driving mechanism to rotate, the slider can be automatically driven by the cam guide component to slide along the radial direction of the circumference of the rotation of the rotation base, so that the station assembly further switches between the expanded posture and the retracted posture when rotating along with the rotation base. That is, the station assembly rotates and switches the posture at the same time. The cam guide component is an interconnected structure, which has high operation reliably, and can effectively prevent interference caused by uncoordinated cooperation.

Alternatively, the driving component includes a driving member and a pulling rod. The driving member is connected to the rotation base in a slidable manner, and is configured to slide along a direction perpendicular to a rotation plane of the rotation base. One end of the pulling rod is hingedly connected to the driving member, and the other end of the pulling rod is hingedly connected to the slider. The structure is simple and easy to implement, and is more adaptable to a case of a relatively large number of station units to ensure the station units to be well interconnected to make the station assembly switch between the expanded posture and the retracted posture. Furthermore, operation manners can be flexibly selected according to needs. The station assembly may rotate and switch the posture at the same time, i.e. the driving member moves to drive the station assembly to switch the posture at the same time when the rotation base is rotating. Or the station assembly may switch the posture first, and then rotate, i.e. firstly the driving member moves to drive the station assembly to switch the posture, and then the rotation base rotates to change the position of the station assembly.

Further, at least two station assemblies are evenly provided along the circumferential direction of the rotation of the rotation base and are spaced apart. The station assemblies are evenly distributed on the rotation base, which can make the entire conveying mechanism for the packaging machinery be more smoothly operate, and can better improve the efficiency of the packaging production.

Further, the at least two station units are provided with a retaining mechanism configured to retain the packaging container. The retaining mechanism keeps the packaging container in a controlled state, so as to facilitate each packaging process.

Further, the retaining mechanism is an elastic bag holding mechanism. The elastic bag holding mechanism includes a bag holder that elastically keeps in an expanded state, and the bag holder is configured to extend into a bag-type packaging container to elastically retain the bag-type packaging container in an opened state. The elastic bag holding mechanism effectively retains the packaging container, and keeps the packaging container in the controlled opened state, such that material can be efficiently filled.

Further, the conveying mechanism for the packaging machinery includes a releasing push mechanism configured to drive the bag holder to switch to a retracted state, and the releasing push mechanism is provided on the at least two station units or at a preset workstation on a rotation path of the station assembly. In this way, the state of the elastic bag holding mechanism can be easily controlled to smoothly load the bag-type packaging container.

Further, the rotation plane of the rotation base is along a horizontal direction, the at least two station units are configured to receive the packaging container along a vertical direction, and the packaging container on the at least two station units is configured to receive the material filled along the vertical direction.

Or, the rotation plane of the rotation base is along the vertical direction, the at least two station units are configured to receive the packaging container along the horizontal direction, and the packaging container on the at least two station units is configured to receive the material filled along the horizontal direction.

Or, an angle between the rotation plane of the rotation base and a horizontal plane is 45°, the at least two station units are configured to receive the packaging container along the horizontal direction, and the packaging container on the at least two station units is configured to receive the material filled along the vertical direction, or the at least two station units are configured to receive the packaging container along the vertical direction, and the packaging container on the at least two station units is configured to receive the material filled along the horizontal direction. The conveying mechanism for the packaging machinery may have various forms to adapt to various situations. The structure of the conveying mechanism for the packaging machinery is selected to match the types of the packaging container and the material.

A packaging machinery includes the above conveying mechanism for the packaging machinery. Each of preset workstations on a conveying path of the conveying mechanism for the packaging machinery is provided with an operating mechanism configured to perform a different packaging process.

Compared with the prior art, the present application has following advantages.

With the conveying mechanism for the packaging machinery and the packaging machinery according to the present application, multiple packaging containers can be processed for packaging production at the same time, and therefore the efficiency of processing operations is effectively improved to achieve efficient and stable packaging production. When the station assembly is circulated and conveyed, the posture of the station assembly switches to decrease the radius of gyration, thereby improving the structural compactness, reducing the volume occupied by the machinery, which are beneficial to elevating the circulation speed, increasing the operation speed of the packaging machinery, and better enhancing the efficiency of the packaging production.

Figure 1:
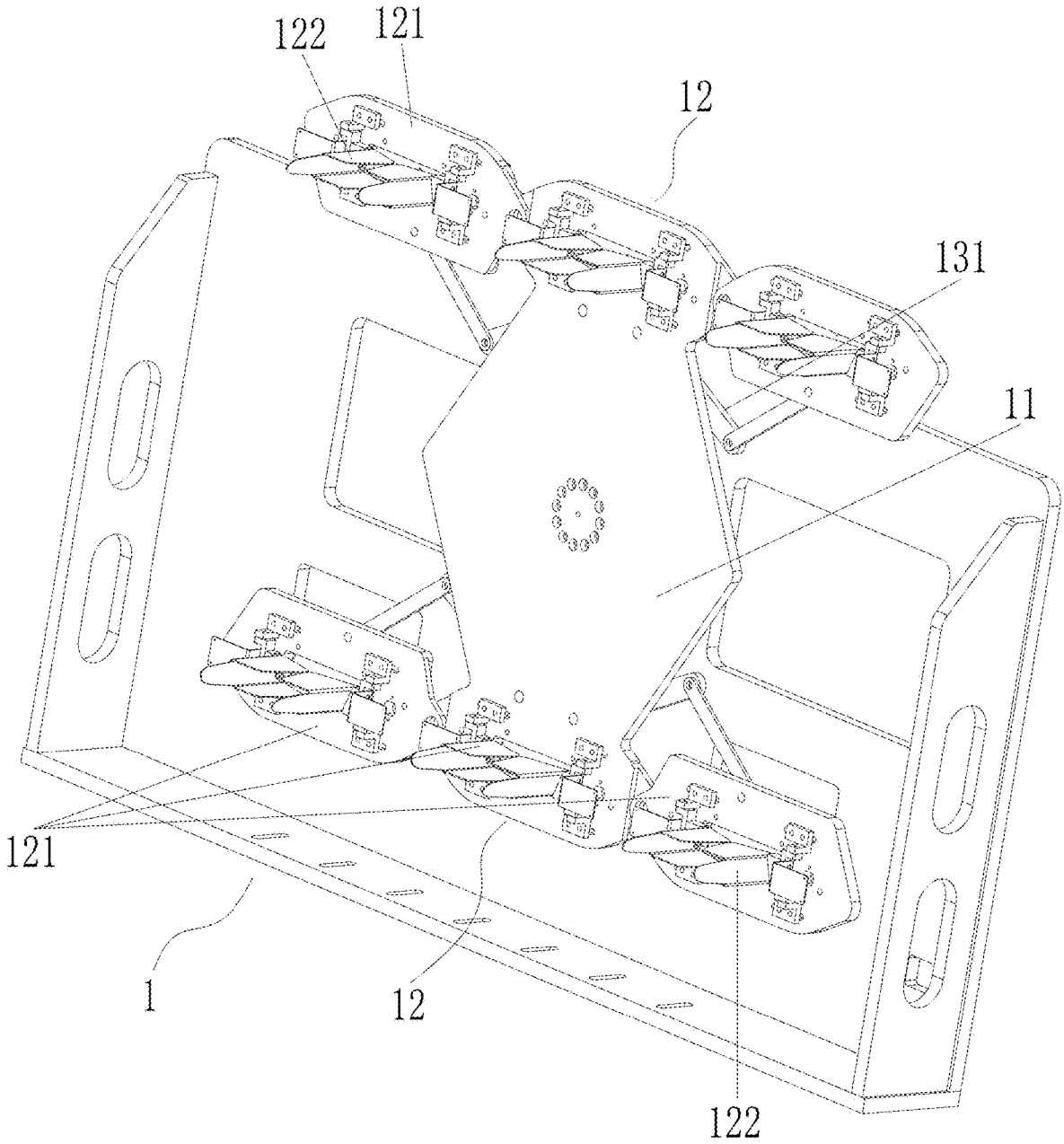
FIG. 1 is a schematic structural view of a conveying mechanism for packaging machinery according to the present application when a station assembly is in an expanded posture.
Figure 2:
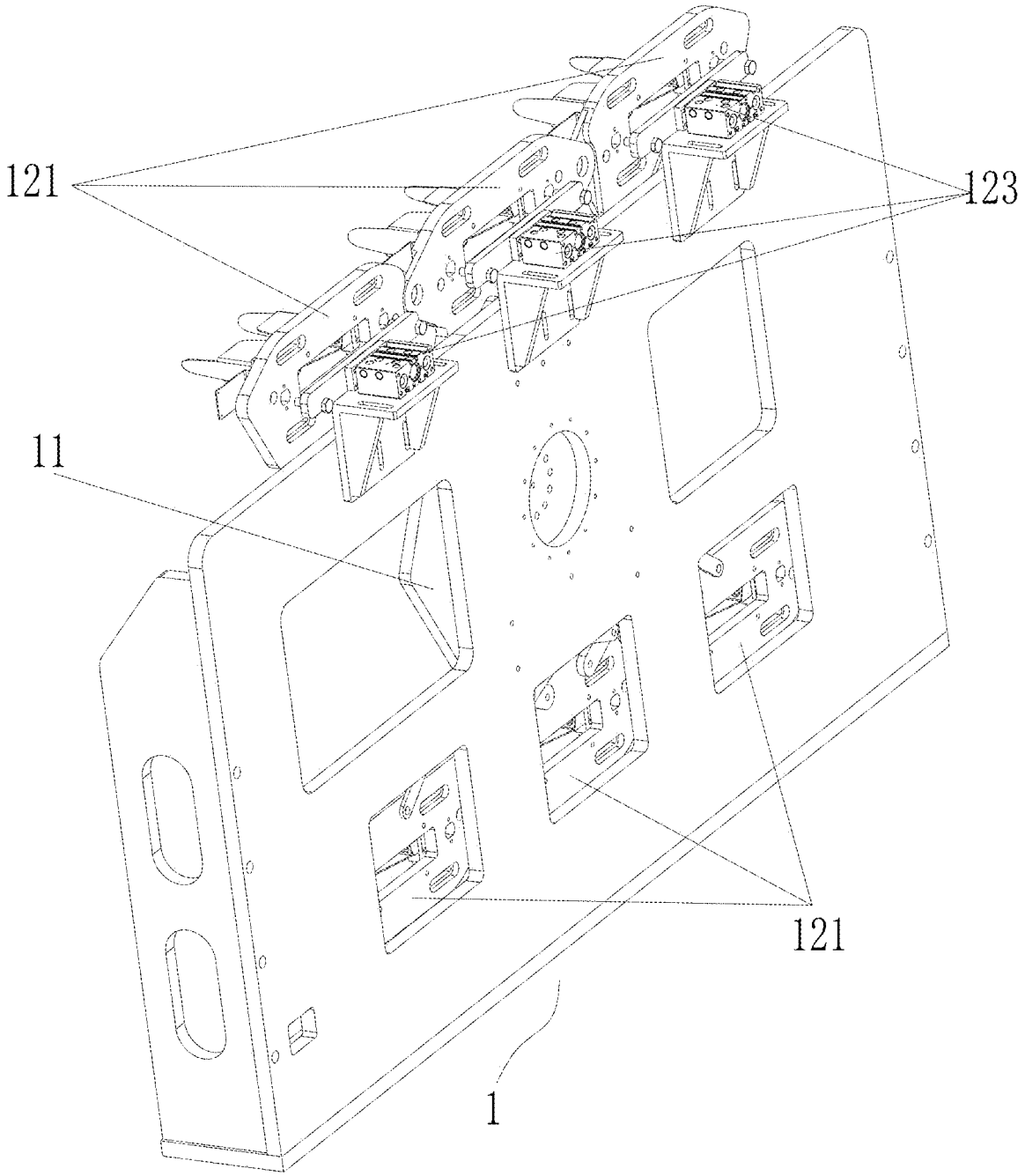
FIG. 2 is a schematic structural view from a back side of FIG. 1.

Reference numerals:

| | | | |
|---|---|---|---|
| 1 | conveying mechanism for packaging machinery, | | |
| 11 | rotation base, | 12 | station assembly, |
| 121 | station unit, | 122 | bag holder, |
| 123 | releasing push mechanism, | 131 | connecting rod assembly, |
| 132 | slider, | 133 | cam guide component, |
| 134 | driving member, | 135 | pulling rod, |
| 136 | linear telescopic driving mechanism, | | |
| 137 | telescopic assembly, | | |
| 2 | packaging container feeding mechanism, | | |
| 21 | bag storage bin, | 22 | bag suction cup, |
| 23 | bag opening suction cup member, | 24 | bag loading moving mechanism, |
| 3 | material filling mechanism, | 31 | material conveyor belt, |
| 32 | pushing assembly, | 4 | material discharging conveyor belt, |
| 5 | sealing mechanism, | 51 | limiting stop plate, |
| 52 | stretching mechanism. | | |

DETAILED DESCRIPTION OF THE EMBODIMENTS

Technical solutions according to the embodiments of the present application will be described clearly and completely as follows in conjunction with the embodiments of the present application. It is obvious that the described embodiments are only a part of the embodiments according to the present application, rather than all of the embodiments. All the other embodiments obtained by those skilled in the art based on the embodiments of the present application without any creative work belong to the scope of protection of the present application.

With a conveying mechanism for packaging machinery and the packaging machinery according to the embodiments of the present application, multiple packaging bags can be processed for packaging production at the same time. The operation efficiency is significantly increased, and efficient and stable packaging production can be realized. Moreover, the structure is compact, the occupied volume is decreased, and the moment of inertia is small. Therefore, the operation is smooth and consumes less energy, the machinery is less complex, and the cost is reduced.

As shown in FIG. 1 to FIG. 4, a conveying mechanism 1 for packaging machinery includes a rotation base 11, a station assembly 12, and an expansion-retraction driving mechanism. The rotation base 11 is driven by a rotation driving mechanism to rotate intermittently. Specifically, the rotation driving mechanism includes a servo motor, a reducer, and a cam indexer, so as to drive the rotation base 11 to rotate with high precision. The station assembly 12 is connected to the rotation base 11, and the station assembly 12 includes at least two station units 121 for arranging a packaging container. The at least two station units 121 of the station assembly 12 are movable with respect to each other. When relative positions of the station units 121 of the station assembly 12 vary, an entire posture of the station assembly 12 changes. Specifically, the station units 121 can be driven by the expansion-retraction driving mechanism to move, so as to make the station assembly 12 switch between an expanded posture and a retracted posture, in which a radius of gyration of the station assembly 12 in the retracted posture is smaller than a radius of gyration of the station assembly 12 in the expanded posture.

The above conveying mechanism for the packaging machinery is employed in packaging machinery. Apart from the conveying mechanism for the packaging machinery, the packaging machinery further includes multiple kinds of operating mechanisms performing various packaging processes. On a conveying path of the conveying mechanism for the packaging machinery, each preset workstation is provided with a different operating mechanism, and each operating mechanism includes a same number of mechanism units in correspondence to the station units 121 of the station assembly 12. When the station assembly 12 rotates to the preset workstation and is in the expanded posture, each mechanism unit performs a packaging process on the corresponding station unit 121.

Specifically, the station assembly 12 is connected to the rotation base 11 to rotate along with the rotation base 11, and the station assembly 12 and the rotation base 11 are combined to form a whole rotating body. When the station assembly 12 is in the expanded posture, the station units 121 of the station assembly 12 are in an expanded state to facilitate various packaging processes (for example, loading the packaging container or filling material) of the operating mechanisms. At this time, the rotating body has a large radius of gyration, and needs more space to rotate. Hence the conveying mechanism for the packaging machinery needs a relatively large space for moving, causing a size of the entire packaging machinery to be relatively large. Furthermore, the large radius of gyration leads to a large moment of inertia. The conveying mechanism for the packaging machinery is a mechanism making intermittent movement, and when the rotating body 11 rotates and conveys the station assembly 12 to the preset workstation, the station assembly 12 is expected to stay at the preset workstation for various packaging processes. In other words, the rotating body frequently switches between a moving state and a rest state. Large moment of inertia may make the rotating body slowly accelerate from the rest state to the moving state and slowly decelerate from the moving state to the rest state. As a result, a rotation speed of the entire rotating body is affected, i.e. the efficiency of circulation of the station assembly 12 between each preset workstation is affected, thereby further affecting processing efficiency of the packaging production. After various packaging processing operations are completed, the station assembly 12 is driven by the expansion-retraction driving mechanism to switch to the retracted posture. The station units 121 of the station assembly 12 is driven by the expansion-retraction driving mechanism to move inwards along a radial direction of the rotation base 11, so as to be in a relatively retracted state, thereby effectively decreasing the radial direction of the rotating body, and reducing the space required for rotation, in this way, the space for the conveying mechanism for the packaging machinery to move is reduced, and the size of the entire packaging machinery is further reduced. With the decrease of the radius of gyration, the moment of inertia is also decreased, and therefore the rotating body speeds up and slows down more quickly. That is, the rotation speed of the entire rotating body is increased, and the circulation efficiency of the station assembly 12 between each preset workstation is improved, so as to better enhance the processing efficiency of the packaging production.

In an embodiment, as shown in FIG. 1 to FIG. 4, the station units 121 of the station assembly 12 are connected in sequence. Every two adjacent station units 121 are hingedly connected, and are driven by the expansion-retraction driving mechanism to deflect with respect to each other, to make the station assembly 12 switch between the expanded posture and the retracted posture. After being connected, the station units 121 of the station assembly 12 form a chain structure. Since every two adjacent station units 121 are hingedly connected, the posture of the entire station assembly 12 can be changed when the two adjacent station units 121 deflect with respect to each other. Specifically, a hinge shaft between the two adjacent station units 121 is perpendicular to the rotation plane of the rotation base 11. In this way, the station units 121 deflect in a plane parallel to the rotation plane of the rotation base 11. That is, the station assembly 12 moves in a plane parallel to the rotation plane of the rotation base 11 to switch the posture. The station units 121 of the station assembly 12 may be arranged linearly or in a curved manner. To facilitate the structural design of the operating mechanism and the parallel packaging processes at multiple workstations, preferably, the station assembly 12 is in the expanded posture when the station units 121 of the station assembly 12 are linearly arranged, so that the mechanism units are conveniently arranged in parallel at each operating mechanism to perform packaging processes on the station units 121. Further, the station units 121 of the station assembly 12 are linearly arranged along the tangential direction of the circumferential direction of the rotation of the rotation base 11. This state facilitates the structural design of the operating mechanism. Correspondingly, the mechanism units of each operating mechanism are linearly arranged in parallel, which is easy to design and implement, and the structure is compact, and interference is better prevented. When the station assembly 12 rotates to the preset workstation and is in the expanded posture where the station units 121 are linearly arranged, the station units 121 are in one-to-one correspondence to the mechanism units of the operating mechanism, such that each mechanism unit performs the packaging process on the corresponding station unit 121. When the station assembly 12 needs to rotate from one preset workstation to a next preset workstation, the station assembly 12 switches to the retracted posture to decrease the radius of gyration. Specifically, the station assembly 12 is in the retracted posture when the station units 121 of the station assembly 12 are arranged along the circumferential direction of the rotation of the rotation base 11. That is, the station units 121, which are linearly arranged along the tangential direction of the circumferential direction of the rotation of the rotation base 11 originally, deflect inwards along the radial direction of the rotation base 11, and are finally arranged along the circumferential direction of the rotation of the rotation base 11. In this way, the radius of gyration of the rotating body is effectively decreased, the space required for rotation is reduced, the size of the conveying mechanism for the packaging machinery is reduced, and the moment of inertia is decreased for faster rotation and switching, thereby increasing the efficiency of the packaging process.

Figure 5:
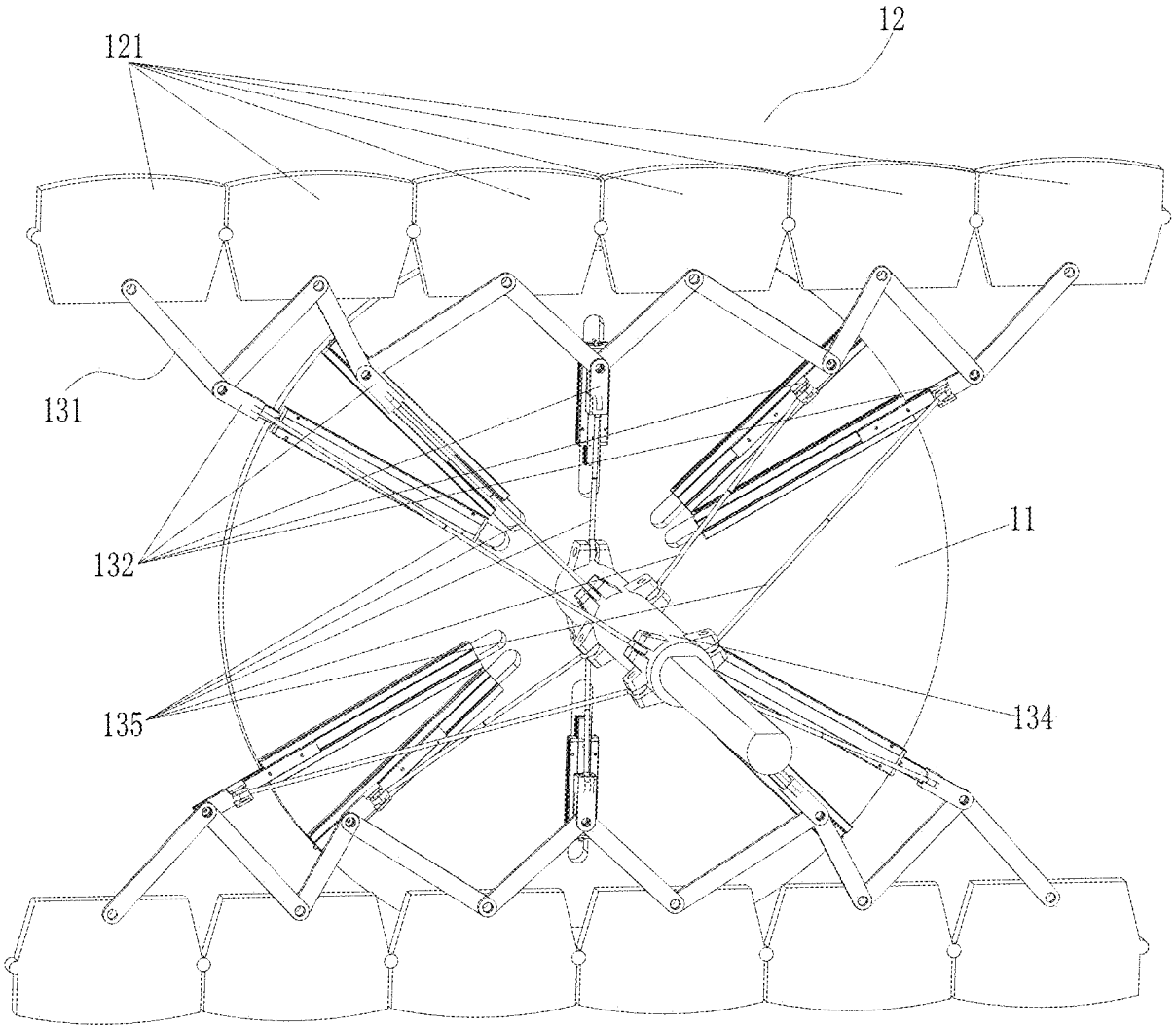
FIG. 5 is a schematic structural view of another packaging machinery conveying mechanism when a station assembly is in an expanded posture.
Figure 7:
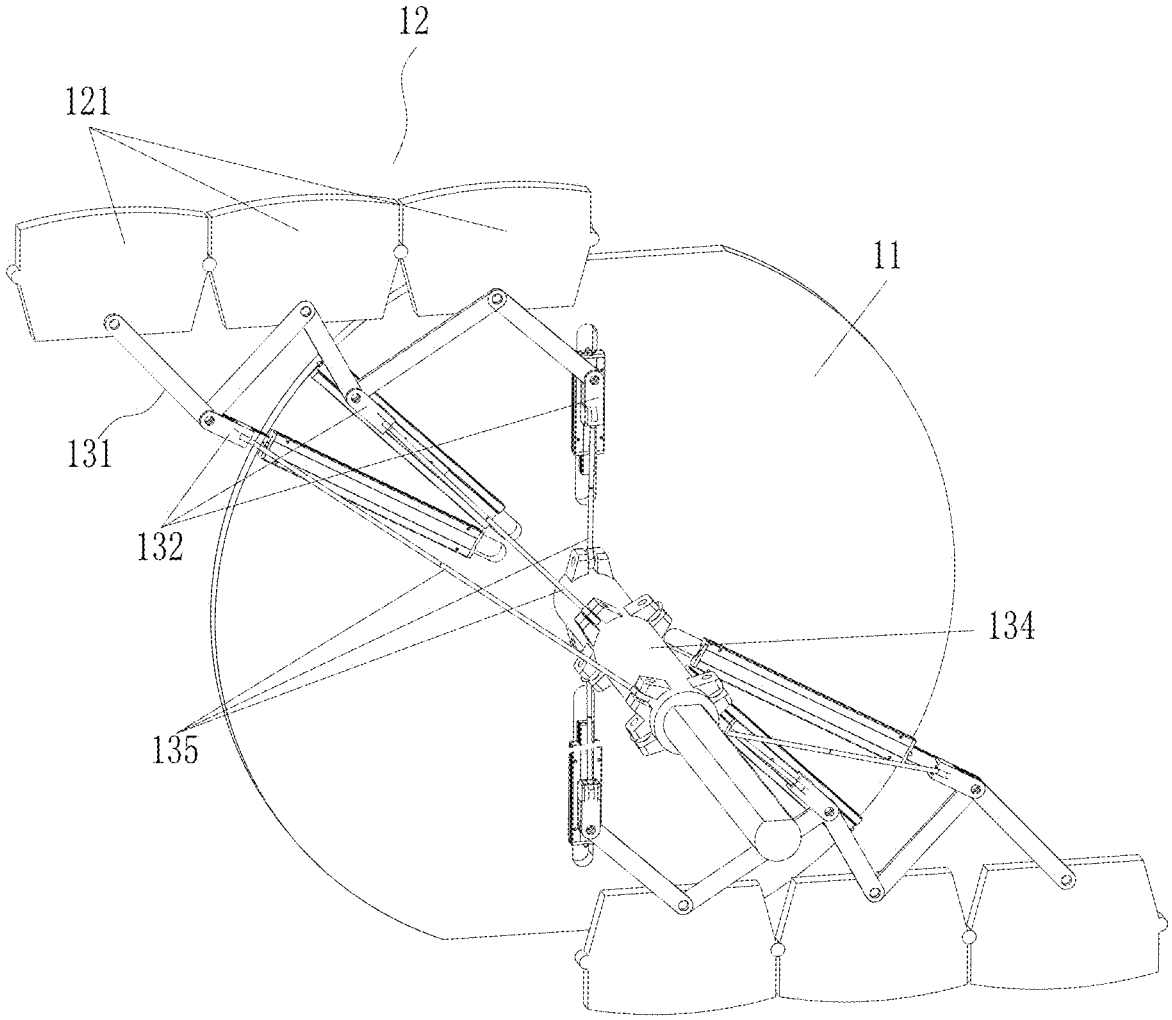
FIG. 7 is a schematic structural view of another packaging machinery conveying mechanism when a station assembly is in an expanded posture.

More specifically, as shown in FIG. 5, when even number of the station units 121 of the station assembly 12 are provided, two of the station units 121 right in the middle are hingedly connected to the rotation base 11. In the present embodiment, the station units 121 of the station assembly 12 are connected one after another in series, and every two adjacent station units 121 are hingedly connected. When hingedly connected to the rotation base 11, the two station units 121 right in the middle can still deflect with respect to each other. When the two station units 121 right in the middle are hingedly connected to the rotation base 11, a middle portion of the station assembly 12 is equivalent to be connected to the rotation base 11. Thus, the station units 121 of the station assembly 12 are symmetrically distributed at both sides of a position where the station assembly 12 is connected to the rotation base 11, such that the station units 121 are more evenly distributed on the rotation base 11, which allows the entire conveying mechanism for the packaging machinery to operate more smoothly. As shown in FIG. 1, when odd number of the station units 121 of the station assembly 12 are provided, one of the station units 121 right in the middle is fixedly connected to the rotation base 11. The station units 121 that are at both sides of the station unit 121 right in the middle and are adjacent to the station unit 121 right in the middle are hingedly connected to the station unit 121 right in the middle, or hingedly connected to the rotation base 11. Similarly, the middle portion of the station assembly 12 is equivalent to be connected to the rotation base 11. The station units 121 of the station assembly 12 are also symmetrically distributed at both sides of the position where the station assembly 12 is connected to the rotation base 11, such that the station units 121 are more evenly distributed on the rotation base 11, which allows the entire conveying mechanism for the packaging machinery to operate more smoothly. Whatever the number of the station units 121 of the station assembly 12 is, when the station assembly is in the expanded posture, the station units 121 of the station assembly 12 are linearly arranged along the tangential direction of the rotation at the position where the station assembly 12 is connected to the rotation base 11, and when the station assembly switches to the retracted posture, the station units 121 at both sides of the position where the station assembly 12 is connected to the rotation base 11 deflect inwards along the radial direction to be arranged along the circumferential direction of the rotation of the rotation base 11. Certainly, in another embodiment, as shown in FIG. 7, a station unit 121 of the station assembly 12 close to an end portion is connected to the rotation base 11. Similarly, the station assembly 12 is in the expanded posture when the station units 121 of the station assembly 12 are linearly arranged along the tangential direction of the circumferential direction of the rotation of the rotation base 11, and is in the retracted posture when the station units 121 of the station assembly 12 are arranged along the circumferential direction of the rotation of the rotation base 11. In this case, the radius of gyration can also be decreased to reduce the occupied volume and increase the rotation speed, while facilitating the packaging processes at multiple stations. However, the station units 121 are unevenly distributed on the rotation base 11, and the rotation smoothness is relatively poor compared with the solution shown in FIG. 1 and FIG. 5.

Figure 8:
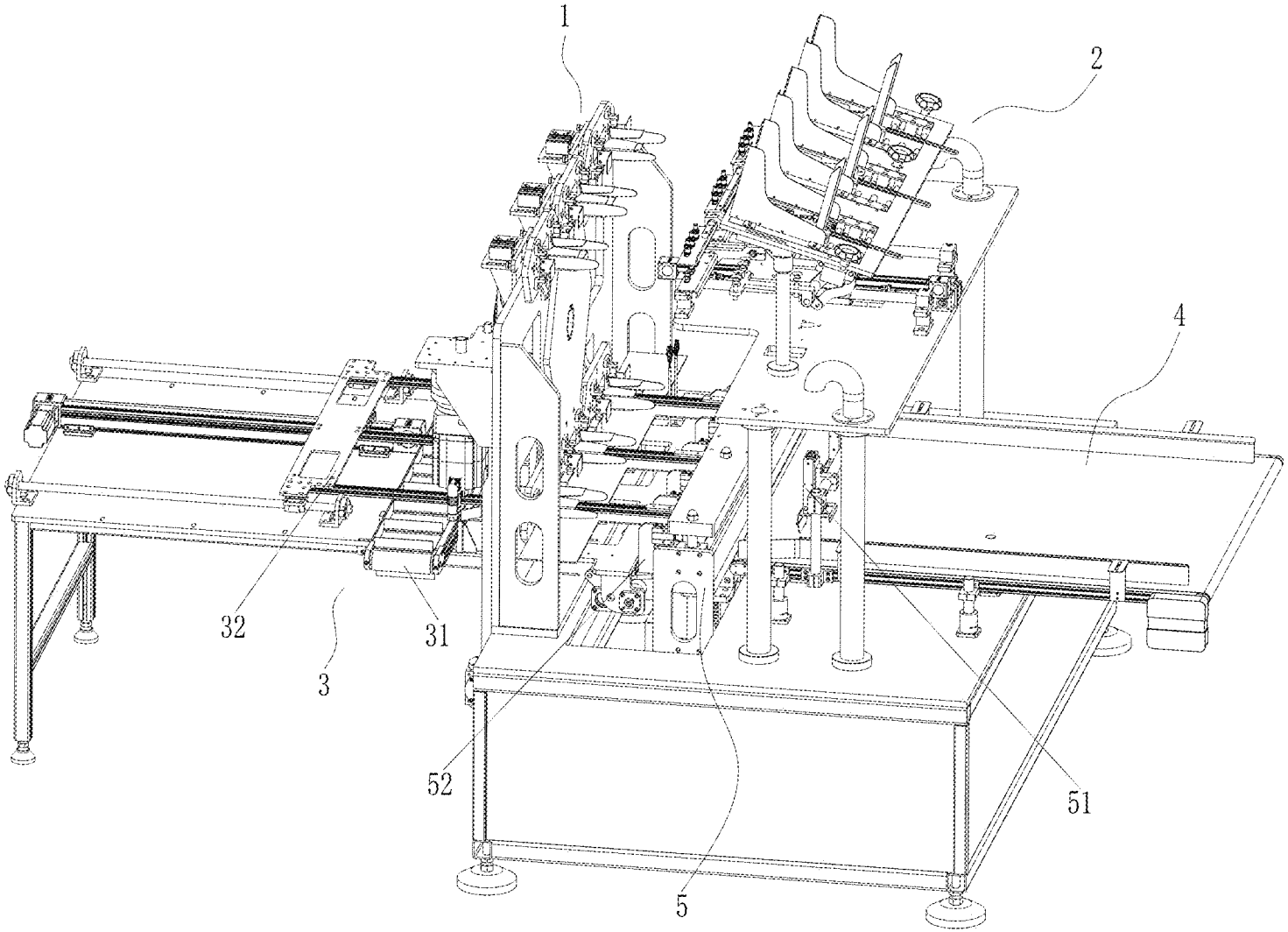
FIG. 8 is a schematic structural view of an entire packaging machinery according to an embodiment of the present application.

In an embodiment, as shown in FIG. 8, the operating mechanisms of the packaging machinery includes a packaging container feeding mechanism 2 and a material filling mechanism 3. The packaging container feeding mechanism 2 includes a same number of feeding units as the station units 121 of the station assembly 12 to load the packaging container onto each station unit 121 of the station assembly 12. The material filling mechanism 3 includes a same number of filling units as the station units 121 of the station assembly 12 to fill the material to the packaging container on each station unit 121 of the station assembly 12. Mechanisms for packaging processes, such as the packaging container feeding mechanism 2 and the material filling mechanism 3, have relatively complicated structures and large sizes. If these mechanisms directly perform packaging processes on each station unit 121 of the station assembly 12 in the retracted posture, the feeding units of the packaging container feeding mechanism 2 and the filling units of the material filling mechanism 3 are distributed in a scattered manner, and are not compact. As a result, the overall structure of the packaging machinery is incompact, the layout is irrational, and the occupied space is large. Both the feeding units of the packaging container feeding mechanism 2 and the filling units of the material filling mechanism 3 have to operate synchronously. When the feeding units of the packaging container feeding mechanism 2 and the filling units of the material filling mechanism 3 are distributed in a scattered manner, interconnection mechanisms are needed, causing the structure of the packaging machinery to be more complicated, and the volume occupied by the machinery to be larger. Therefore, to better improve the compactness of the overall structure of the packaging machinery, preferably, the feeding units of the packaging container feeding mechanism 2 are linearly arranged in parallel, and the filling units of the material filling mechanism 3 are linearly arranged in parallel. In this way, structures of the packaging container feeding mechanism 2 and the material filling mechanism 3 are compact and easy to design and implement. Correspondingly, the station assembly 12 has to be in the expanded posture to make the station units 121 of the station assembly 12 be in one-to-one correspondence to the feeding units of the packaging container feeding mechanism 2, and to make the station units 121 of the station assembly 12 be in one-to-one correspondence to the filling units of the material filling mechanism 3, so as to effectively perform each packaging process. Then, the station assembly 12 switches to the retracted posture when being circulated between each preset workstation, thereby improving the circulation efficiency and better enhancing the processing efficiency of the packaging production.

Figure 11:
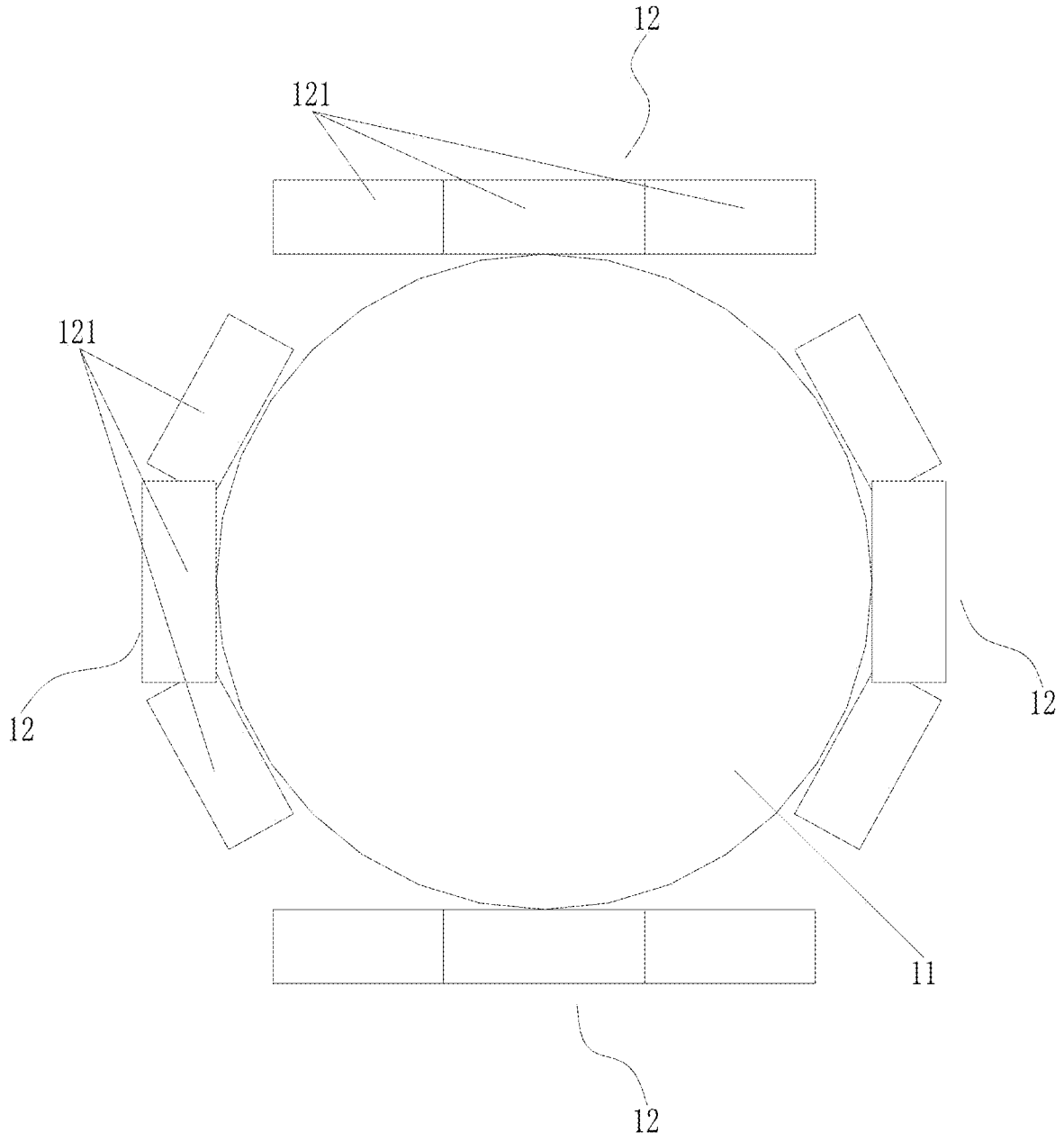
FIG. 11 is a schematic structural view of another packaging machinery conveying mechanism.

Further, as shown in FIG. 1 and FIG. 8, two station assemblies 12 are evenly provided along the circumferential direction of the rotation of the rotation base 11 and are spaced apart. Two preset workstations are provided on the conveying path of the conveying mechanism 1 for the packaging machinery, such that the station assembly 12 can be circulated and switched between the preset workstations as the rotation base 11 drives the station assembly 12 to rotate by 180°. The packaging container feeding mechanism 2 is provided at one of the preset workstations, and the material filling mechanism 3 is provided at the other of the preset workstations. When one of the two station assemblies 12 rotates to the preset workstation where the packaging container feeding mechanism 2 is, the other of the two station assemblies 12 rotates to the preset workstation where the material filling mechanism 3 is. In this way, different packaging processes can be performed in parallel, such that no operating mechanism is unoccupied, thereby enhancing the processing efficiency of the packaging production. In a case that more station assemblies 12 and more preset workstations are provided, there is always a corresponding station assembly 12 rotates to each of other preset workstations in place when one of the station assemblies 12 rotates to one of the preset workstations, such that various packaging processes can be performed in parallel, thereby enhancing the processing efficiency of the packaging production. Further, the number of the station assemblies 12 may be the same as the number of the preset workstations, or the number of the station assemblies 12 may be larger than the number of the preset workstations, so as to ensure each of the preset workstations to have a corresponding station assembly 12 rotated in place at the same time, such that the operating mechanism at each preset workstation can perform the packaging process at the same time. In an embodiment, as shown in FIG. 11, four station assemblies 12 are evenly arranged on the rotation base 11 and are spaced apart, while only two preset workstations are provided. The two preset workstations are arranged at two ends of a diameter of the rotation base 11. Each station assembly 12 exactly switches to the expanded posture completely when rotating to the preset workstation, and completely switches to the retracted posture on a line perpendicular to a line connecting the two preset workstations. In this case, although the rotation base 11 has to drive the station assembly 12 to rotate by 180° to circulate and switch the station assembly 12 between the preset workstations, the rotation base 11 only needs to rotate by 90° in each step to circulate each station assembly 12 between the preset workstations in sequence for packaging processes, since the number of the station assemblies 12 is larger than the number of the preset workstations.

Figure 3:
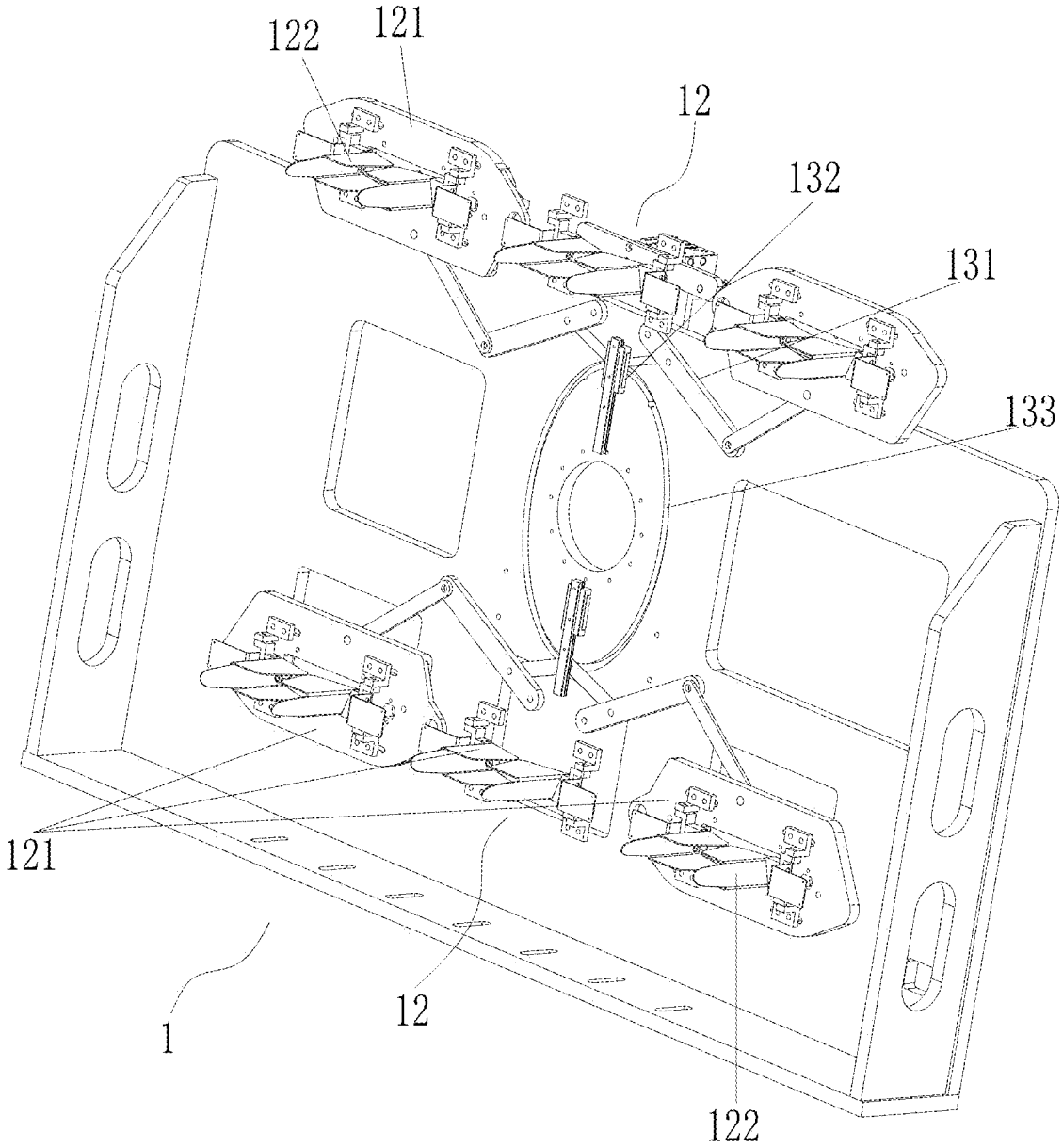
FIG. 3 is a schematic structural view of FIG. 1 where a rotation base is hidden.
Figure 4:
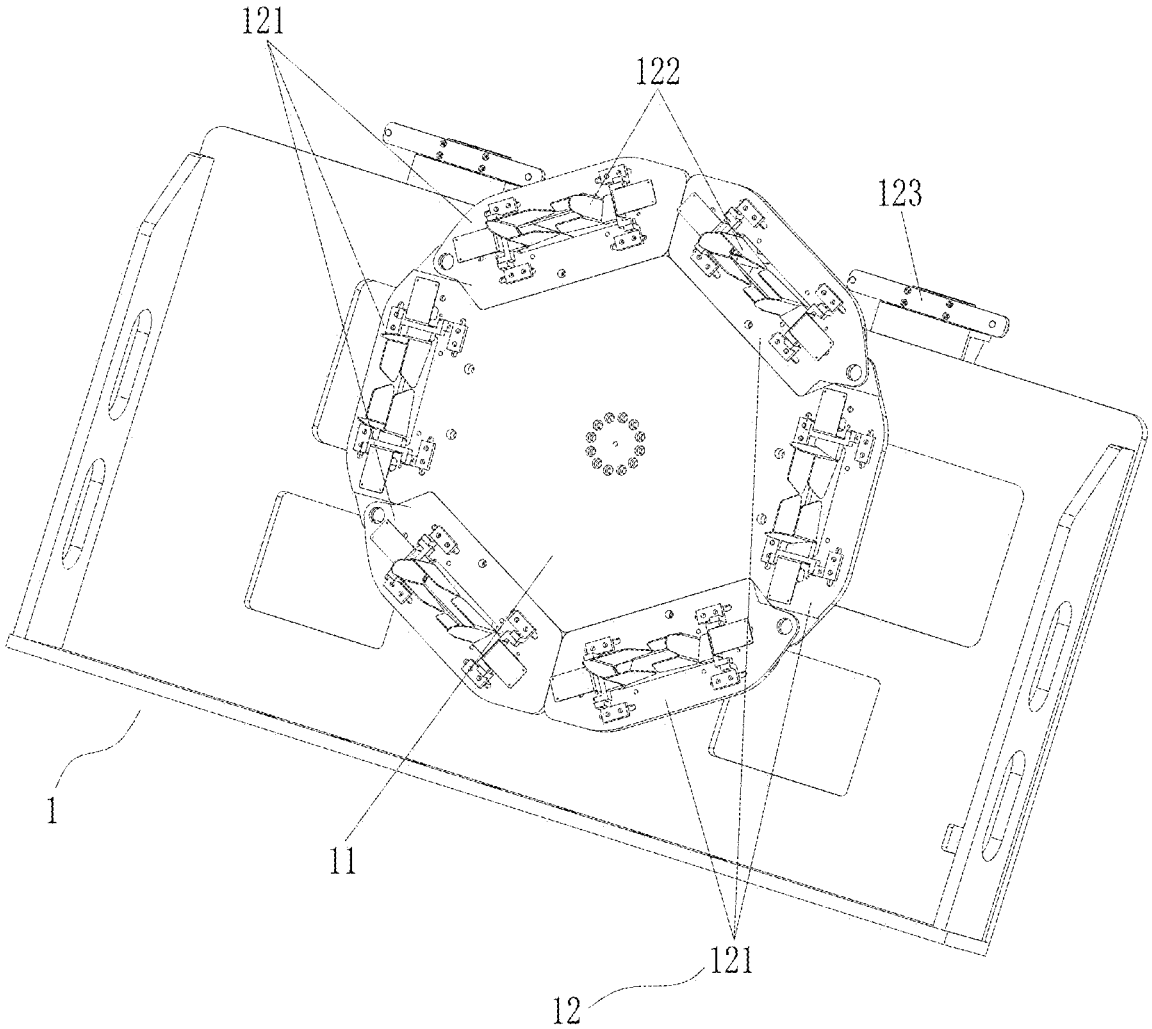
FIG. 4 is a schematic structural view of the conveying mechanism for the packaging machinery shown in FIG. 1 when the station assembly is in a retracted posture.

The station units 121 of the station assembly 12 are movable with respect to each other. In this way, the posture of the station assembly 12 is switched by the change of relative positions of the station units 121. To make the expansion-retraction driving mechanism automatically drive the station assembly 12 to move to switch the posture, as shown in FIG. 1 to FIG. 4, the expansion-retraction driving mechanism includes a driving component, a connecting rod assembly 131, and a slider 132. The slider 132 is connected to the rotation base 11 in a slidable manner, and is configured to slide along a radial direction of a circumference of the rotation of the rotation base 11. The slider 132 is connected to the station units 121 of the station assembly 12 through the connecting rod assembly 131, and the driving component drives the slider 132 to move along the radial direction of the circumference of the rotation of the rotation base 11, so as to make the station assembly 12 switch between the expanded posture and the retracted posture. Various types of the driving component may be employed. As shown in FIG. 3, the driving component is a cam guide component 133 that is stationary. The cam guide component 133 may specifically be a guide groove or a guide track. The slider 132 is connected to the cam guide component 133 in a slidable manner, and the slider 132 rotates along with the rotation base 11 and is driven by the cam guide component 133 to move. This structure is simple and easy to implement, while an additional power component is not needed. Specifically, the cam guide component 133 may be arranged on a stationary support plate. A path of the cam guide component 133 is a loop around the rotation circumference of the rotation base 11, and a distance between each point on the path of the cam guide component 133 and a center of rotation of the rotation base 11 varies along the path of the cam guide component 133. The rotation base 11 is driven by the rotation driving mechanism to rotate. The slider 132 slides along the cam guide component 133, and the cam guide component 133 drives the slider 132 to slide along the radial direction of the circumference of the rotation of the rotation base 11 with respect to the rotation base 11. The slider 132 drives the station units 121 to move through the connecting rod assembly 131, such that the station assembly 12 switches between the expanded posture and the retracted posture when rotating along with the rotation base 11. That is, the station assembly 12 rotates and switches the posture at the same time. The cam guide component 133 is an interconnected structure, which has high operation reliability, and can effectively prevent interference caused by uncoordination. In this embodiment, the cam guide component 133 is roughly an ellipse. When the rotation base 11 drives the station assembly 12 to rotate to a position on a major axis of the ellipse, the station assembly 12 is in the expanded posture which is fully expanded. When the rotation base 11 drives the station assembly 12 to rotate to another position on a minor axis of the ellipse, the station assembly 12 is in the retracted posture which is fully retracted. When rotating between the major axis and the minor axis of the ellipse, the station assembly 12 is gradually changing the posture, i.e. the posture gradually changes when the station assembly 12 is rotating along with the rotation base 11. More specifically, FIG. 1 is referred to for description. The station assembly 12 includes three station units 121. One of the station units 121 right in the middle is fixed onto the rotation base 11, and each of two sides of the station unit 121 right in the middle is hingedly connected with one station unit 121. The slider 132 is connected to a guide track arranged on the rotation base 11 in a slidable manner. The connecting rod assembly 131 consists of multiple connecting rods. As shown in FIG. 1 and FIG. 3, in an implementation, the connecting rod assembly 131 includes a first connection rod, a second connection rod, and a third connection rod. One end of the first connection rod is hingedly connected to the slider 132, and the other end of the first connection rod is hingedly connected to a middle portion of the second connection rod. One end of the second connection rod is hingedly connected to the rotation base 11, the other end of the second connection rod is hingedly connected to one end of the third connection rod, and the other end of the third connection rod is hingedly connected to the station unit 121 on the left. Similarly, the station unit 121 on the right is connected to the slider 132 through another set of first connection rod, second connection rod, and third connection rod. When the slider 132 slides with respect to the rotation base 11, the slider 132 drives the second connection rod to deflect with respect to the rotation base 11 through the first connection rod, and the second connection rod pulls the station unit 121 on the left to deflect with respect to the station unit 121 right in the middle through the third connection rod. In this way, the station units 121 are driven by the expansion-retraction driving mechanism to move to make the station assembly 12 switch between the expanded posture and the retracted posture. Other implementations of the connecting rod assembly 131 may be employed. In another implementation, the connecting rod assembly 131 and the slider 132 are combined to form a crank linkage mechanism to realize conversion between a rotation and a linear motion. In an example, the station assembly 12 includes three station units 121. The station unit 121 right in the middle is fixed onto the rotation base 11, and each of two sides of the station unit 121 right in the middle is hingedly connected with one station unit 121. The connecting rod assembly 131 may include only one connecting rod. One end of the connecting rod is hingedly connected to the slider 132, and the other end of the connecting rod is hingedly connected to the station unit 121 of the station assembly 12 at an end side. The slider 132 can also drive the station unit 121 to deflect when sliding with respect to the rotation base 11, so as to make the station assembly 12 switch between the expanded posture and the retracted posture. Besides, the cam guide component 133 may be driven by an additional power mechanism to rotate, to achieve an operation manner that the station assembly 12 switches from the expanded posture to the retracted posture first, and then the rotation base 11 rotates. Specifically, before the rotation base 11 rotates, the cam guide component 133 is driven by the power mechanism to rotate with respect to the rotation base 11, such that the cam guide component 133 drives the slider 132 to slide with respect to the rotation base 11 to switch the posture of the station assembly 12. When the station assembly 12 has switched to the retracted posture, the rotation base 11 starts to rotate, and at this time, the cam guide component 133 rotates in sync with the rotation base 11 to keep the station assembly 12 in the retracted posture. After the station assembly 12 rotates in place, the cam guide component 133 rotates with respect to the rotation base 11 to switch the station assembly 12 to the expanded posture for the packaging processes.

Figure 6:
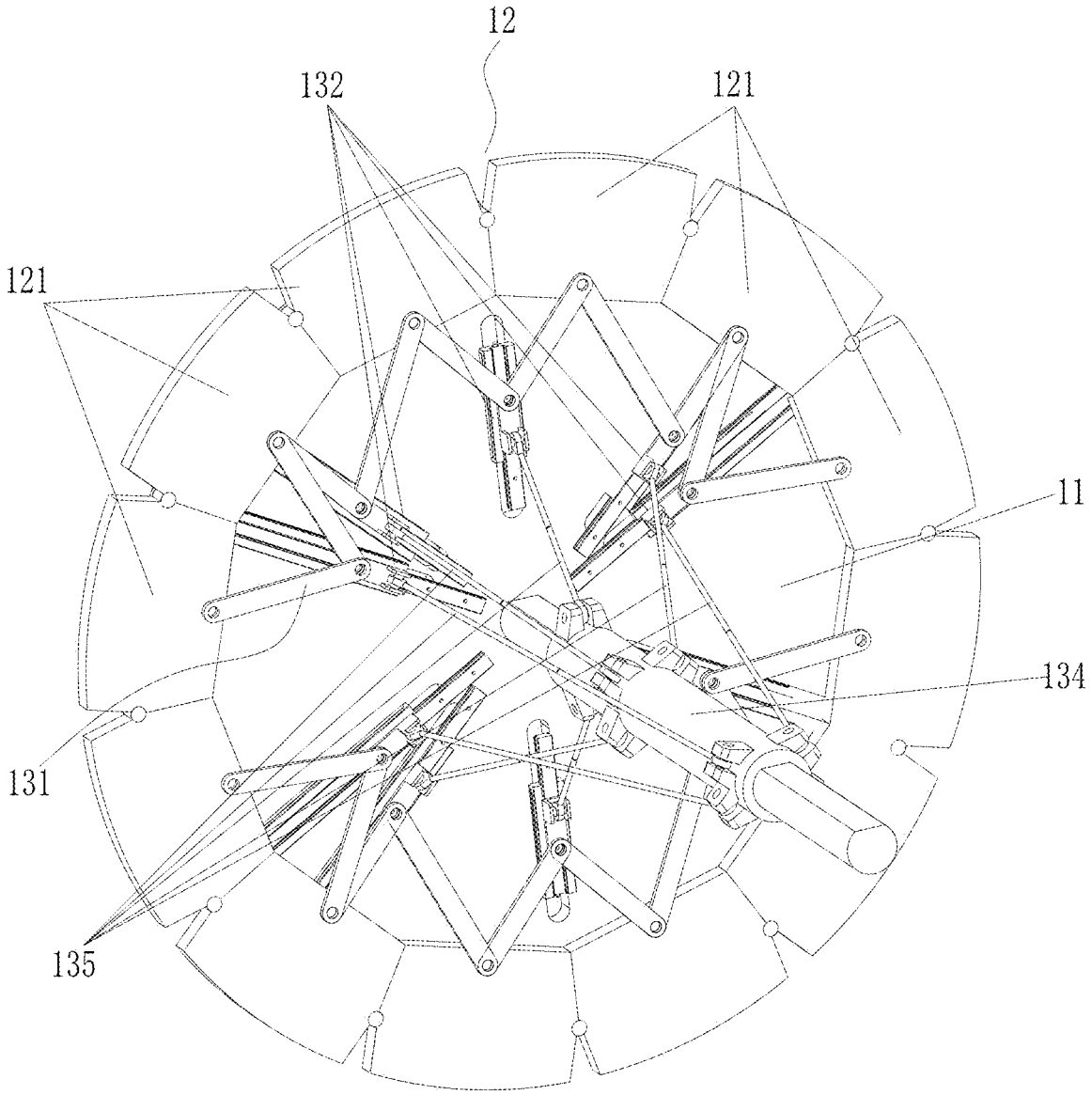
FIG. 6 is a schematic structural view of the conveying mechanism for the packaging machinery shown in FIG. 5 when the station assembly is in a retracted posture.

Alternatively, as shown in FIG. 5 and FIG. 6, the driving component includes a driving member 134 and a pulling rod 135. The driving member 134 is connected to the rotation base 11 in a slidable manner, and is configured to slide along a direction perpendicular to a rotation plane of the rotation base 11. One end of the pulling rod 135 is hingedly connected to the driving member 134, and the other end of the pulling rod 135 is hingedly connected to the slider 132. Specifically, in FIG. 5, the station assembly 12 includes six station units 121 that are hingedly connected one after another. The six station units 121 in a top region of FIG. 5 are sequentially defined as a first station unit through a sixth station unit from left to right. The third and the fourth station units 121 right in the middle are hingedly connected to the rotation base 11. The rotation base 11 is provided with a guide rod perpendicular to the rotation plane of the rotation base 11, and the driving member 134 is a cylindrical member sleeved on the guide rod in a slidable manner. Multiple sliders 132 are provided and are spaced apart along the circumferential direction of the rotation of the rotation base 11. Specifically, five sliders 132 are provided. Each slider 132 is connected to the rotation base 11 in a slidable manner along the radial direction of the circumference of the rotation of the rotation base 11. The five sliders 132 in the top region of FIG. 5 are defined as a first slider through a fifth slider in sequence from left to right. The connecting rod assembly 131 includes a first connecting rod through a tenth connecting rod in sequence from left to right. Specifically, one end of the first connecting rod is hingedly connected to the first station unit, and the other end of the first connecting rod is hingedly connected to the first slider. One end of the second connecting rod is hingedly connected to the second station unit, and the other end of the second connecting rod is hingedly connected to the first slider. One end of the third connecting rod is hingedly connected to the second station unit, and the other end of the third connecting rod is hingedly connected to the second slider. One end of the fourth connecting rod is hingedly connected to the third station unit, and the other end of the fourth connecting rod is hingedly connected to the second slider. One end of the fifth connecting rod is hingedly connected to the third station unit, and the other end of the fifth connecting rod is hingedly connected to the third slider. One end of the sixth connecting rod is hingedly connected to the fourth station unit, and the other end of the sixth connecting rod is hingedly connected to the third slider. One end of the seventh connecting rod is hingedly connected to the fourth station unit, and the other end of the seventh connecting rod is hingedly connected to the fourth slider. One end of the eighth connecting rod is hingedly connected to the fifth station unit, and the other end of the eighth connecting rod is hingedly connected to the fourth slider. One end of the ninth connecting rod is hingedly connected to the fifth station unit, and the other end of the ninth connecting rod is hingedly connected to the fifth slider. One end of the tenth connecting rod is hingedly connected to the sixth station unit, and the other end of the tenth connecting rod is hingedly connected to the fifth slider. The first slider through the fifth slider are connected to the driving member 134 through different pulling rods respectively. A pulling rod connected to the first slider and a pulling rod connected to the fifth slider are connected to a distal end of the driving member 134 away from the rotation base 11. A pulling rod connected to the third slider is connected to a proximal end of the driving member 134 close to the rotation base 11. A pulling rod connected to the second slider and a pulling rod connected to the fourth slider are connected to the driving member 134 between the distal end and the proximal end. When sliding along the guide rod, the driving member 134 drives each slider 132 to move, and the sliders 132 further drives the station units 121 through the connecting rod assembly 131 to deflect, so as to finally make the station assembly 12 switch between the expanded posture and the retracted posture. With the above expansion-retraction driving mechanism, operation manners can be flexibly selected according to needs. The station assembly 12 may rotate and switch the posture at the same time, i.e. the driving member 134 moves to drive the station assembly 12 to switch the posture at the same time when the rotation base 11 is rotating. Or, the station assembly 12 may switch the posture first, and then rotate, i.e., the driving member 134 moves to drive the station assembly 12 to switch the posture first, and then the rotation base 11 rotates to change the position of the station assembly 12, so as to flexibly satisfy various demands. The motion of the driving member 134 perpendicular to the rotation plane of the rotation base 11 may be driven by a linear telescopic mechanism, which moves along an axial direction of the guide rod. The linear telescopic mechanism may be an air cylinder, an electric push rod or the like, or may be a cam groove mechanism that is stationary with respect to the rotation base 11. When rotating along with the rotation base 11, the driving member 134 is automatically driven by the cam groove mechanism to move along the guide rod.

Figure 12:
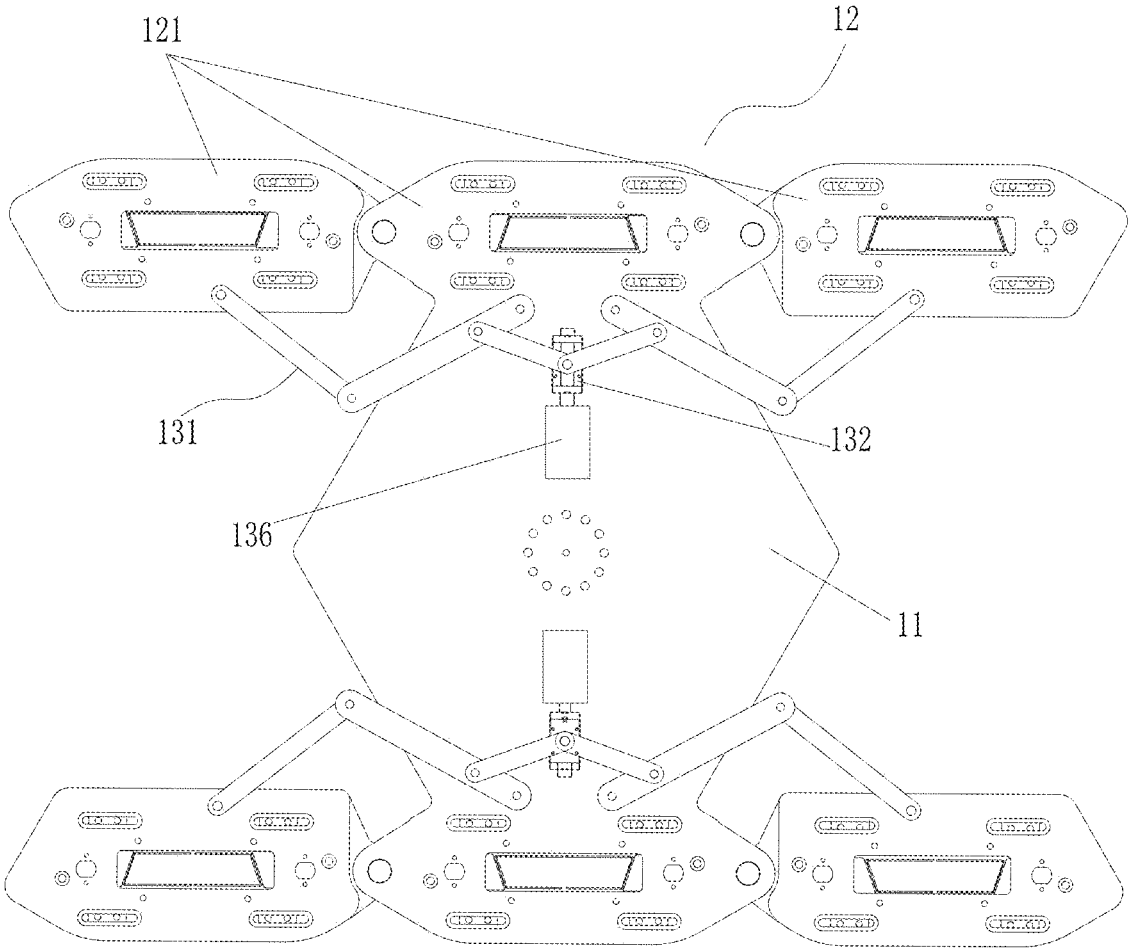
FIG. 12 is a schematic structural view of another packaging machinery conveying mechanism.

As shown in FIG. 12, the driving component may directly employ a linear telescopic driving mechanism 136, which may be an air cylinder, an electric push rod or the like. The linear telescopic driving mechanism 136 is arranged on the rotation base 11, and moves back and forth along a direction along which the slider 132 slides, so as to drives the slider 132 to move. This structure is simple and easy to implement. However, the linear telescopic driving mechanism 136 is an additional power mechanism, and needs power supply. That is, the linear telescopic driving mechanism 136 needs to be connected with a pneumatic tube or an electric wire. As the linear telescopic driving mechanism 136 rotates along with the rotation base 11, wiring design becomes more difficult. If the linear telescopic driving mechanism 136 is used, operation manners can be flexibly selected according to needs. The station assembly 12 may rotate and switch the posture at the same time, i.e., the linear telescopic driving mechanism 136 moves to drive the station assembly 12 to switch the posture at the same time when the rotation base 11 is rotating. Or, the station assembly 12 may switch the posture first, and then rotate, i.e., the linear telescopic driving mechanism 136 moves to drive the station assembly 12 to switch the posture first, and then the rotation base 11 rotates to change the position of the station assembly 12.

Figure 13:
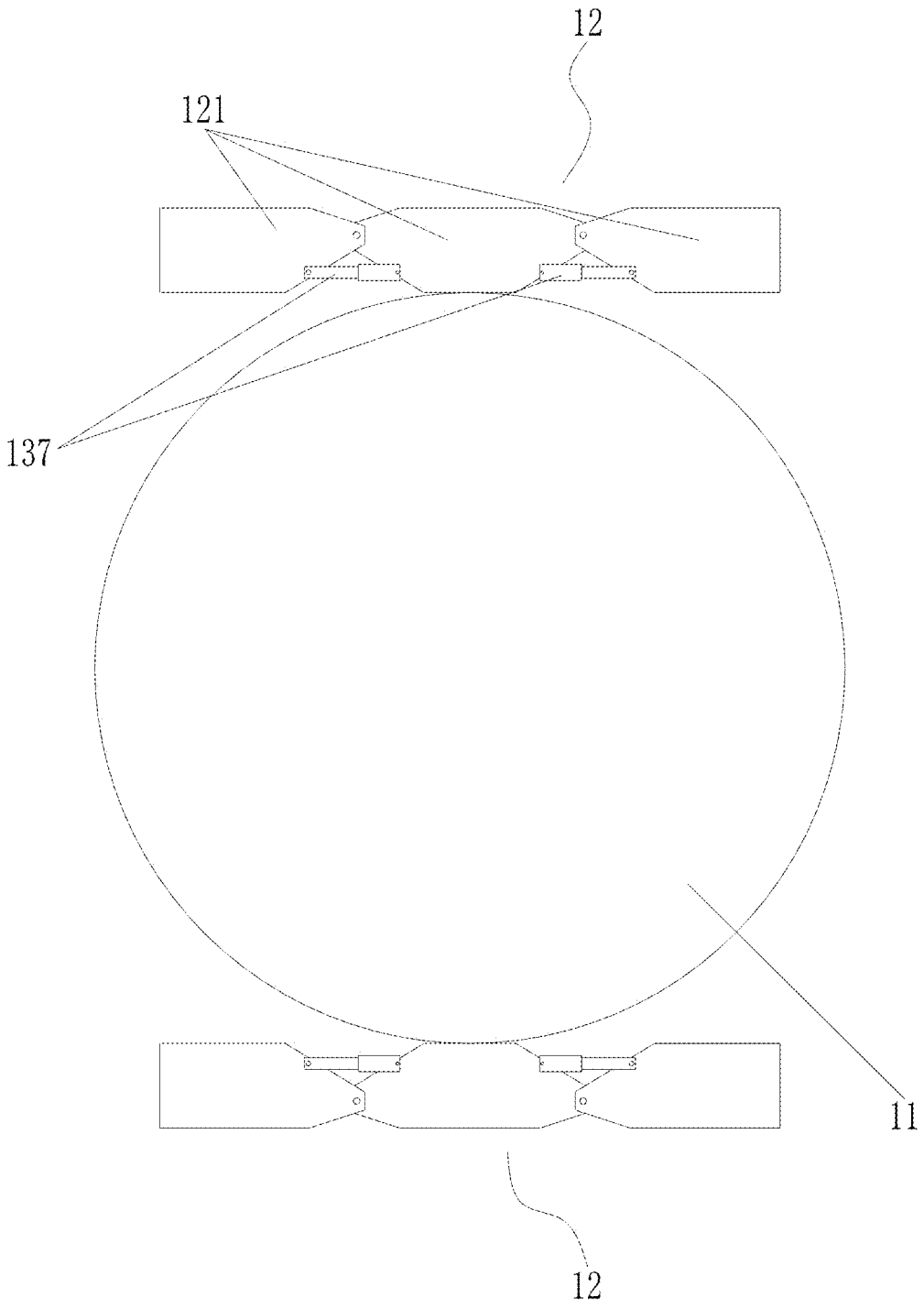
FIG. 13 is a schematic structural view of another packaging machinery conveying mechanism.

As shown in FIG. 13, the expansion-retraction driving mechanism may be a telescopic assembly 137 that is directly arranged between every two adjacent station units 121. Specifically, the telescopic assembly 137 may be an air cylinder, an electric push rod or the like. One end of the telescopic assembly 137 is connected to one station unit 121, and the other end of the telescopic assembly 137 is hingedly connected to another station unit 121 adjacent to the one station unit 121. The telescopic assembly 137 moves back and forth to drive the two adjacent station units 121 to deflect with respect to each other, so as to further drive the station assembly 12 to switch between the expanded posture and the retracted posture.

In an embodiment, as shown in FIG. 1 and FIG. 8, the rotation plane of the rotation base 11 is along a vertical direction. Each station unit 121 receives the packaging container along a horizontal direction, and the packaging container on the station unit 121 receives the material filled along the horizontal direction. Specifically, preset workstations are arranged at a highest point and a lowest point of the conveying path of the conveying mechanism 1 for the packaging machinery. The preset workstation at the highest point is provided with the packaging container feeding mechanism 2, and the preset workstation at the lowest point is provided with the material filling mechanism 3. The packaging container feeding mechanism 2 loads the packaging container onto the station unit 121 along the horizontal direction, and the material filling mechanism 3 fills the material into the packaging container on the station unit 121 along the horizontal direction. This structure is suitable for filling of blocky materials. Regarding the work flow of the packaging process, when rotating to the preset workstation where the packaging container feeding mechanism 2 is, the station assembly 12 switches to the expanded posture, and then the packaging container feeding mechanism 2 conveys and puts the packaging container onto each of the station units 121. After that, the rotation base 11 drives the station assembly 12 to rotate to change its position. During the rotation and the change of the position, the station assembly 12 switches to the retracted posture to reduce the radius of gyration and the moment of inertia. When rotating to the preset workstation where the material filling mechanism 3 is, the station assembly 12, on which the packaging container is arranged, switches to the expanded posture again, and then the material filling mechanism 3 fills the material into the packaging container on each station unit 121.

Figure 14:
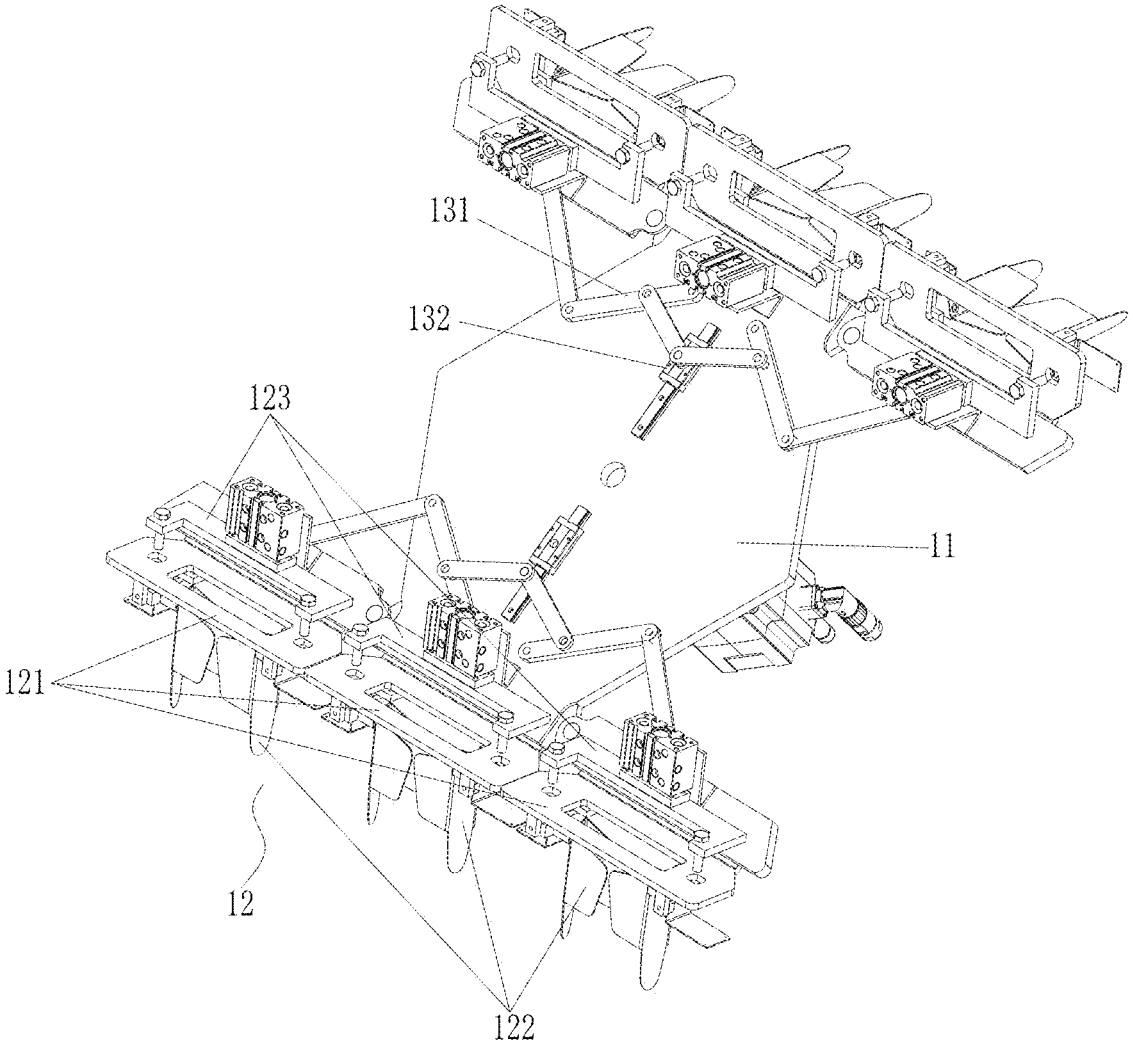
FIG. 14 is a schematic structural view of another packaging machinery conveying mechanism when a station assembly is in an expanded posture.
Figure 15:
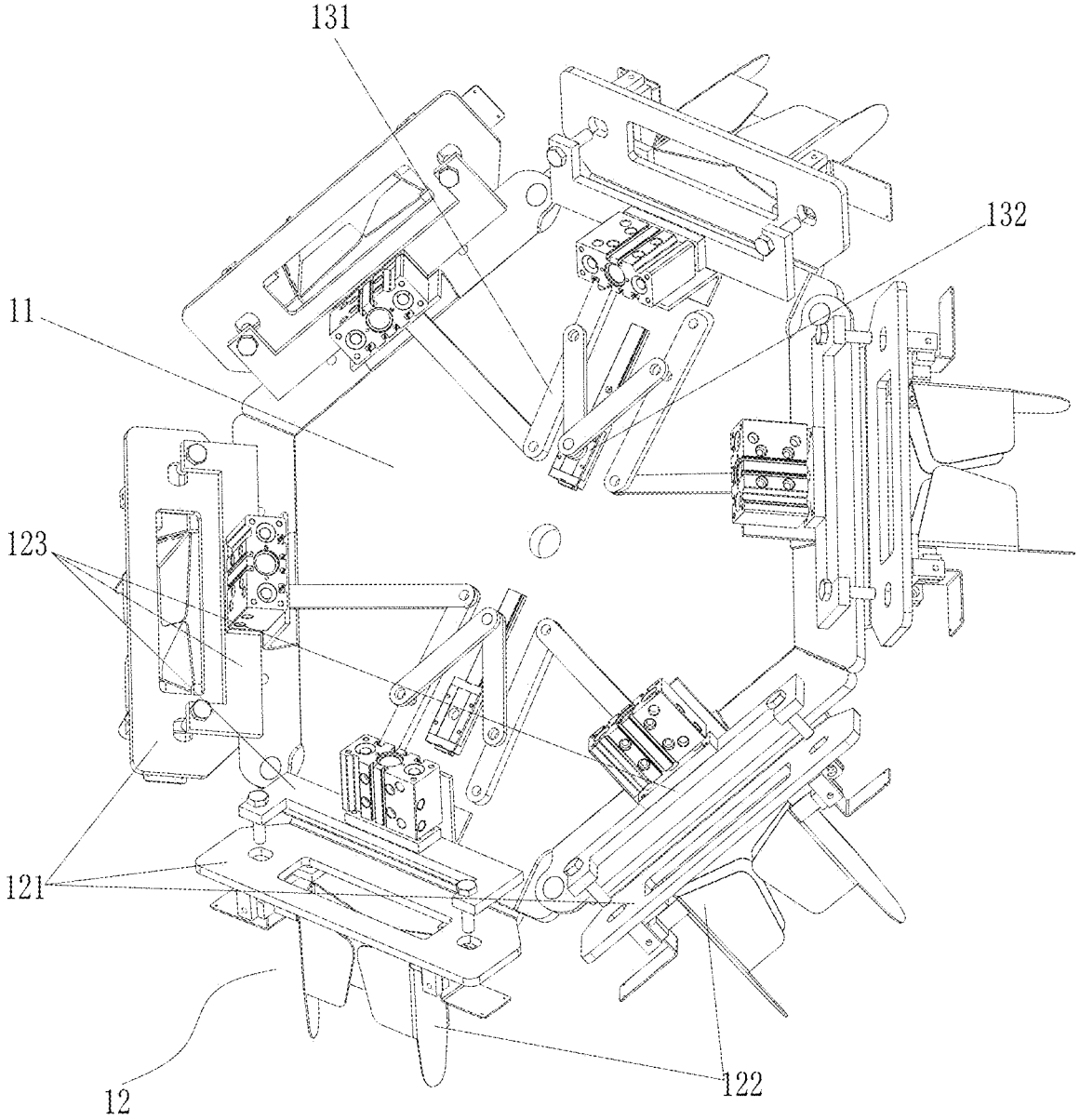
FIG. 15 is a schematic structural view of the conveying mechanism for the packaging machinery shown in FIG. 14 when the station assembly is in a retracted posture.

Each station unit 121 is provided with a retaining mechanism for retaining the packaging container. The retaining mechanism keeps the packaging container in a controlled state, so as to facilitate each process of the packaging production. Specifically, the packaging container may be a box-type packaging container that has a certain volume, or may be a bag-type packaging container (i.e. a packaging bag). For the box-type packaging container, the station unit 121 may be provided with only a groove for accommodating the box-type packaging container, and the box-type packaging container needs not to be additionally clamped and retained. For the packaging bag, the retaining mechanism may be a clamping member that clamps edges of two sides of the packaging bag respectively. In addition, the retaining mechanism may be an elastic bag holding mechanism shown in FIG. 1. The elastic bag holding mechanism includes a bag holder 122 that is elastically in an expanded state, and the bag holder 122 is configured to insert into the packaging bag to keep the packaging bag in an opened state. The bag holder 122 is used for not only retaining the packaging bag but also keeping the packaging bag to be in a controlled opened state stably, so as to facilitate a highly efficient material filling operation. This solution is suitable for filling of blocky materials, especially for filling of materials along the horizontal direction, where an opening portion of the packaging bag is kept open by the elastic bag holding mechanism. The bag holder 122 is connected to the station unit 121 in a detachable manner, so that the size and specification of the bag holder 122 can be conveniently changed according to needs, so as to flexibly adapt to demands of packaging of materials of different specifications. A direction of the elastic bag holding mechanism is perpendicular to the rotation plane of the rotation base 11. That is, an angle between a direction of the opening portion of the packaging bag encasing the elastic bag holding mechanism and the rotation plane of the rotation base 11 is 90°. Since the rotation plane of the rotation base 11 is along the vertical direction, the opening portion of the packaging bag encasing the elastic bag holding mechanism faces the horizontal direction, and the blocky materials can be pushed into the packaging bag along the horizontal direction to realize material filling. The conveying mechanism for the packaging machinery further includes a releasing push mechanism 123 in cooperation with the elastic bag holding mechanism. The releasing push mechanism 123 is configured for pushing the bag holder 122 to switch to a retracted state. As shown in FIG. 14, the releasing push mechanism 123 is provided on the station unit 121. Or, as shown in FIG. 1, the releasing push mechanism 123 is provided at the preset workstation where the releasing push mechanism 123 is needed. When the latter solution is adopted, less releasing push mechanism 123 is needed, and the load weight of the rotation base 11 is reduced, which decreases the power consumption for driving the rotation base 11 to rotate. Specifically, the releasing push mechanism 123 may be a push mechanism driven by an air cylinder for pushing the bag holder 122 to move against an action force of an elastic member, so as to make the elastic bag holding mechanism switch to the retracted state. When the packaging bag is loaded onto the elastic bag holding mechanism on the station unit 121, the releasing push mechanism 123 acts first to make the bag holder 122 switch to the retracted state, so as to ensure the packaging bag to smoothly encase the elastic bag holding mechanism. Then, the releasing push mechanism 123 resets to stop pushing the bag holder 122, and the bag holder 122 elastically restores to the expanded state to retain and keep the packaging bag in the opened state.

Figure 9:
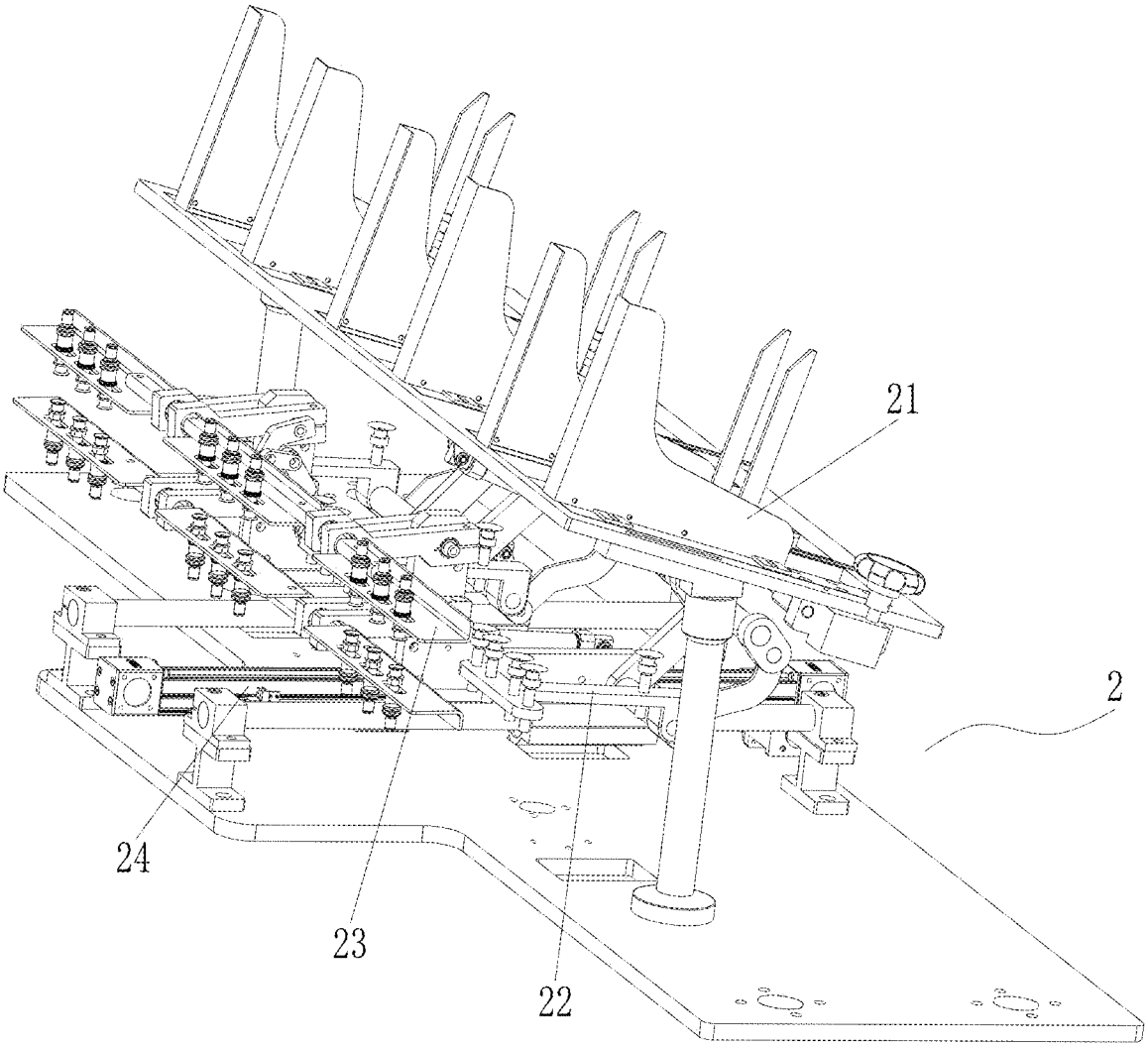
FIG. 9 is a schematic structural view of a packaging container feeding mechanism of the packaging machinery shown in FIG. 8.

More specifically, as shown in FIG. 9, each feeding unit of the packaging container feeding mechanism 2 includes a bag storage bin 21, a bag taking assembly, and a bag loading assembly. Packaging bags are stacked in the bag storage bin 21, and a lower portion of the bag storage bin 21 is provided with an outlet, from which the packaging bag is taken out. The bag taking assembly includes a bag suction cup 22, which moves back and forth at the outlet of the bag storage bin 21 to take out the packaging bag one after another. Specifically, the bag suction cup 22 is connected to a rotation shaft, and the rotation shaft is driven by an air cylinder to make the bag suction cup 22 move back and forth by deflecting. The bag suction cup 22 moves forth to the outlet of the bag storage bin 21 and sucks the packaging bag, and then moves back away from the outlet of the bag storage bin 21 to take the packaging bag out from the outlet of the bag storage bin 21. The bag loading assembly includes a bag opening suction cup member 23, and a bag loading moving mechanism 24 that drives the bag opening suction cup member 23 to move. The bag opening suction cup member 23 is driven by the bag loading moving mechanism 24 to move back and forth between a position of the bag suction cup 22 and a position of the station assembly 12 at the preset workstation, and the bag opening suction cup member 23 receives the bag-type packaging container taken out by the bag suction cup 22. The bag opening suction cup member 23 moves to the position of the bag suction cup 22, and two sets of suction cups of the bag opening suction cup member 23 respectively suck surfaces of two sides of the packaging bag being taken out. Then the bag suction cup 22 releases the packaging bag, and the two sets of suction cups of the bag opening suction cup member 23 perform an opening operation to open the opening portion of the packaging bag. Then the bag opening suction cup member 23 is driven by the bag loading moving mechanism 24 to move towards the station assembly 12 at the preset workstation. Under the action of the releasing push mechanism 123, the elastic bag holding mechanism on the station unit 121 switches to the retracted state. Then the packaging bag can encase the elastic bag holding mechanism. The releasing push mechanism 123 resets and stops pushing the bag holder 122, and the bag holder 122 elastically restores to the expanded state to retain the packaging bag on the station unit 121. The bag opening suction cup member 23 releases the packaging bag and is driven by the bag loading moving mechanism 24 to move away from the station assembly 12 at the preset workstation. Through the above steps, the packaging process of bag loading is completed, and the packaging bag is loaded onto the station unit 121 and is stably kept in the controlled opened state, so as to facilitate the sequent packaging process.

Figure 10:
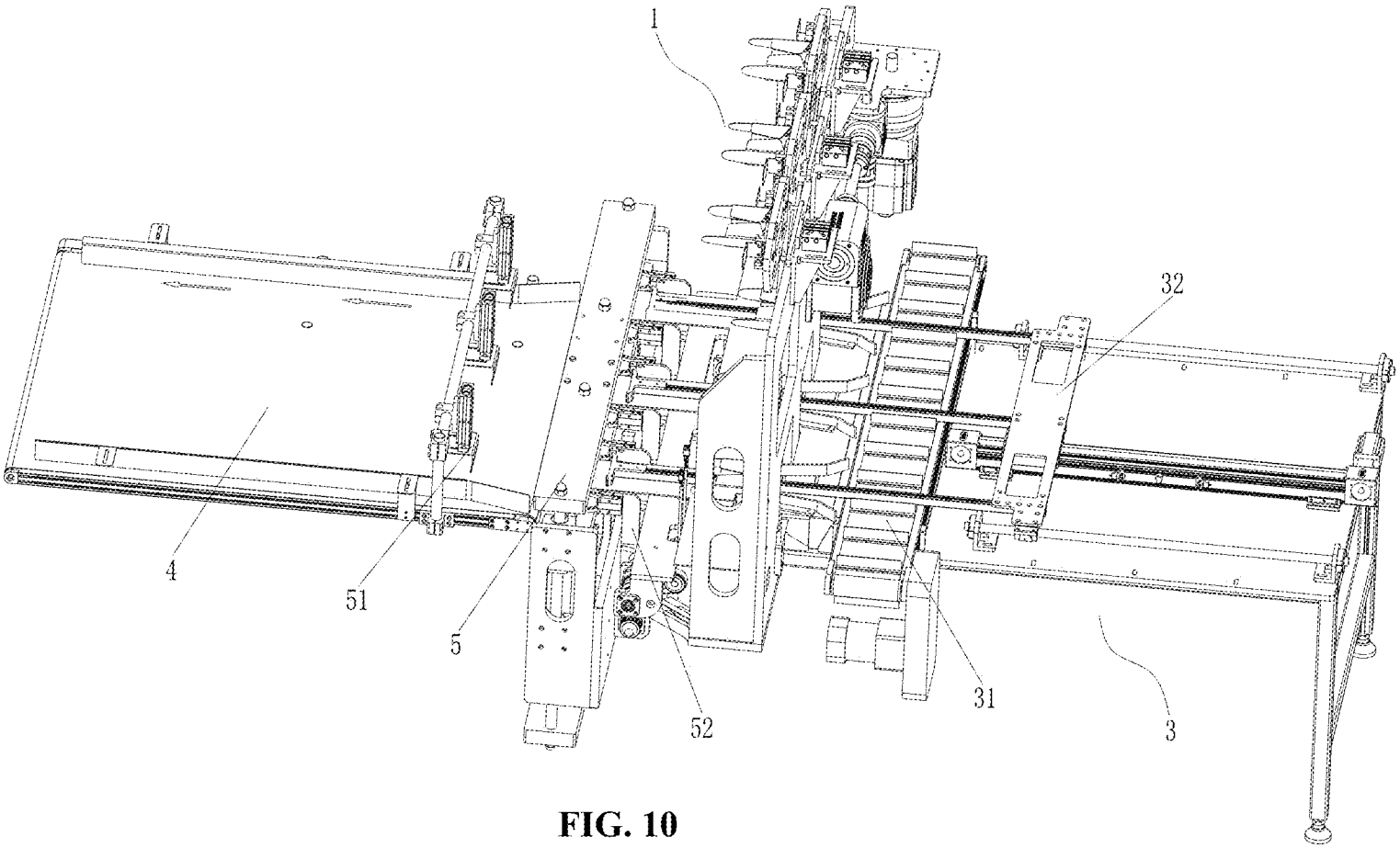
FIG. 10 is a schematic structural view of a material filling mechanism of the packaging machinery shown in FIG. 8.

As shown in FIG. 10, the material filling mechanism 3 includes a material conveyor belt 31, and a same number of pushing assemblies 32 as the station units 121 of the station assembly 12. The pushing assemblies 32 are the filling units. The material conveyor belt 31 conveys along a horizontal transverse direction, and the material is put onto the material conveyor belt 31 in a spaced manner to be conveyed intermittently. The station units 121 of the station assembly 12 in the expanded posture at the preset workstation where the material filling mechanism 3 is are linearly arranged along a direction parallel to a conveying direction of the material conveyor belt 31. Each pushing assembly 32 pushes along a direction perpendicular to the conveying direction of the material conveyor belt 31. When the station assembly 12 rotates to the preset workstation where the material filling mechanism 3 is and is in the expanded posture, the station units 121 are located on a pushing path of the pushing assembly 32, and the opening portion of the packaging container on each station unit 121 faces a side where the pushing assembly 32 is. The pushing assembly 32 pushes the material on the material conveyor belt 31 to fill the material into the packaging container on the station unit 121, and the pushing assembly 32 pushes the packaging container out of the elastic bag holding mechanism. In short, the material filling mechanism 3 is used for not only material filling but also bag unloading. After being filled with the material, the packaging container immediately gets out of the station unit to proceed to the next process. Specifically, the pushing assembly 32 includes a pushing rod and a linear pushing driving mechanism. To improve structural compactness and operation synchronicity, all of the pushing assemblies 32 share one linear pushing driving mechanism. Each pushing rod in cooperation with the corresponding station unit 121 is connected to a support, and the support is driven by the linear pushing driving mechanism to move. The support is connected to a guiding slide mechanism parallel to the linear pushing driving mechanism in a slidable manner, so as to ensure the precision and stability of the pushing operation of the pushing rod.

Further, as shown in FIG. 10, a material discharging conveyor belt 4 is provided at the preset workstation where the material filling mechanism 3 is, and the material discharging mechanism is configured to receive the packaging bag that is filled with the material and is pushed out. The material discharging conveyor belt 4 receives the packaging bags on all of the station units 121 of the station assembly 12 at the same time, and the structure is simple, compact, and easy to implement. A sealing mechanism 5 is further provided at an entrance end of the material discharging conveyor belt 4, such that the packaging bag, right after being filled with the material and pushed out, is sealed by the sealing mechanism 5 before being discharged by the material discharging conveyor belt 4. More specifically, a limiting stop plate 51 that moves up and down is provided above the entrance end of the material discharging conveyor belt 4. The limiting stop plate 51 is configured to limit and block the packaging bag that is filled with the material and enters the entrance end of the material discharging conveyor belt 4, such that the opening portion of the packaging bag is exactly at the sealing mechanism 5, so as to ensure the sealing process to be precisely performed. To improve the quality of the sealing process, a stretching mechanism 52 is provided at the sealing mechanism 5. The stretching mechanism 52 includes a left stretching clamp and a right stretching clamp that are paired. The left stretching clamp and the right stretching clamp are configured to respectively clamp edges of two sides of the opening portion of the packaging bag, and can move towards each other to open or close, so as to tightly stretch the opening portion of the packaging bag to keep the opening portion in a flat state for sealing, improve the sealing quality, prevent the opening portion of the packaging bag from wrinkling, and ensure the sealing performance and the aesthetics after the sealing process. The stretching mechanism 52 further includes a moving assembly, and the moving assembly drives the left stretching clamp and the right stretching clamp to switch between an avoidance position and an operation position. At the avoidance position, the left stretching clamp and the right stretching clamp do not hinder the packaging bag filled with the material from entering into the sealing mechanism 51 at the entrance end of the material discharging conveyor belt 4. When the packaging bag filled with the material is pushed in place, the left stretching clamp and the right stretching clamp switch to the operation position to tightly stretch the opening portion of the packaging bag for the sealing process.

Figure 16:
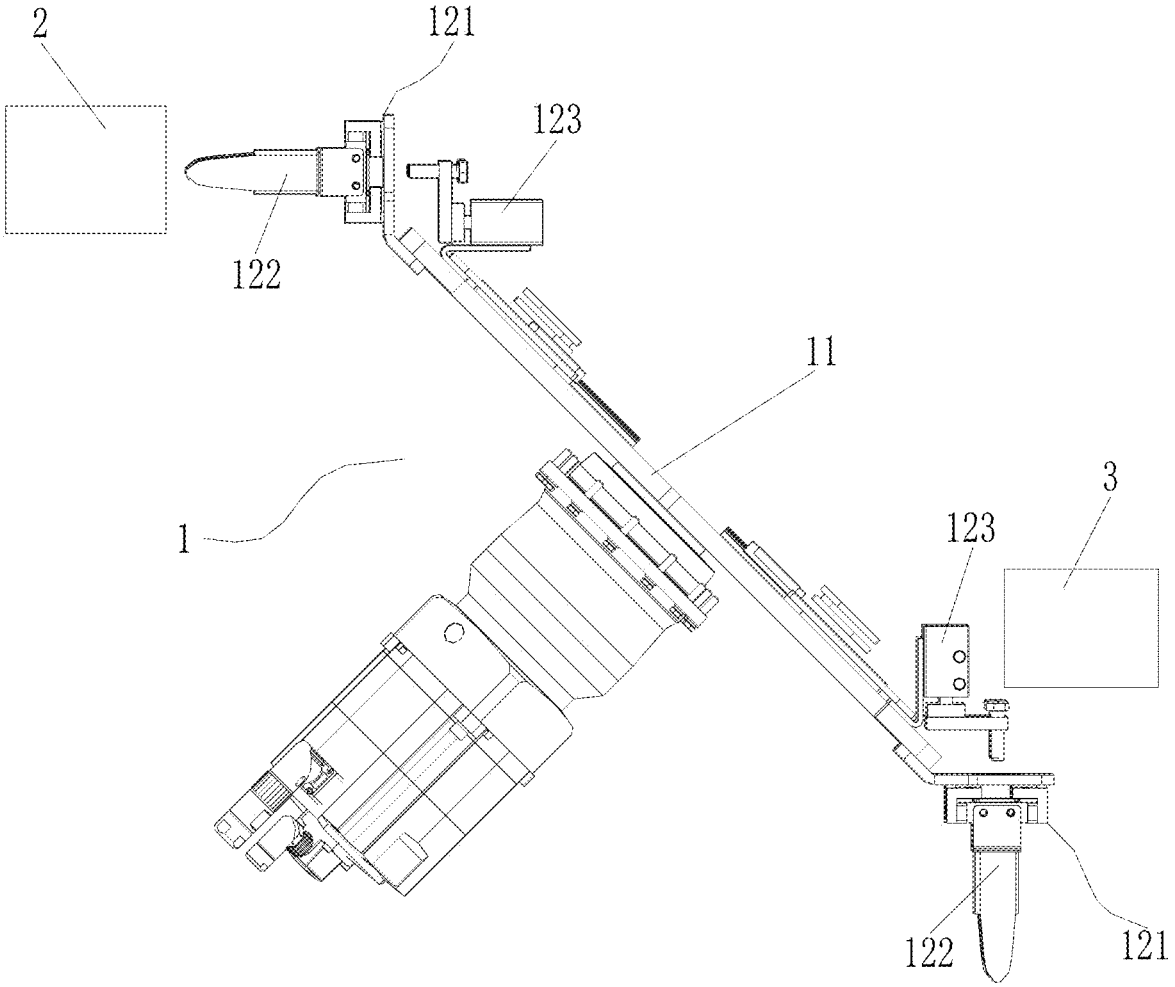
FIG. 16 is a schematic structural view of a packaging machinery according to another embodiment.
Figure 17:
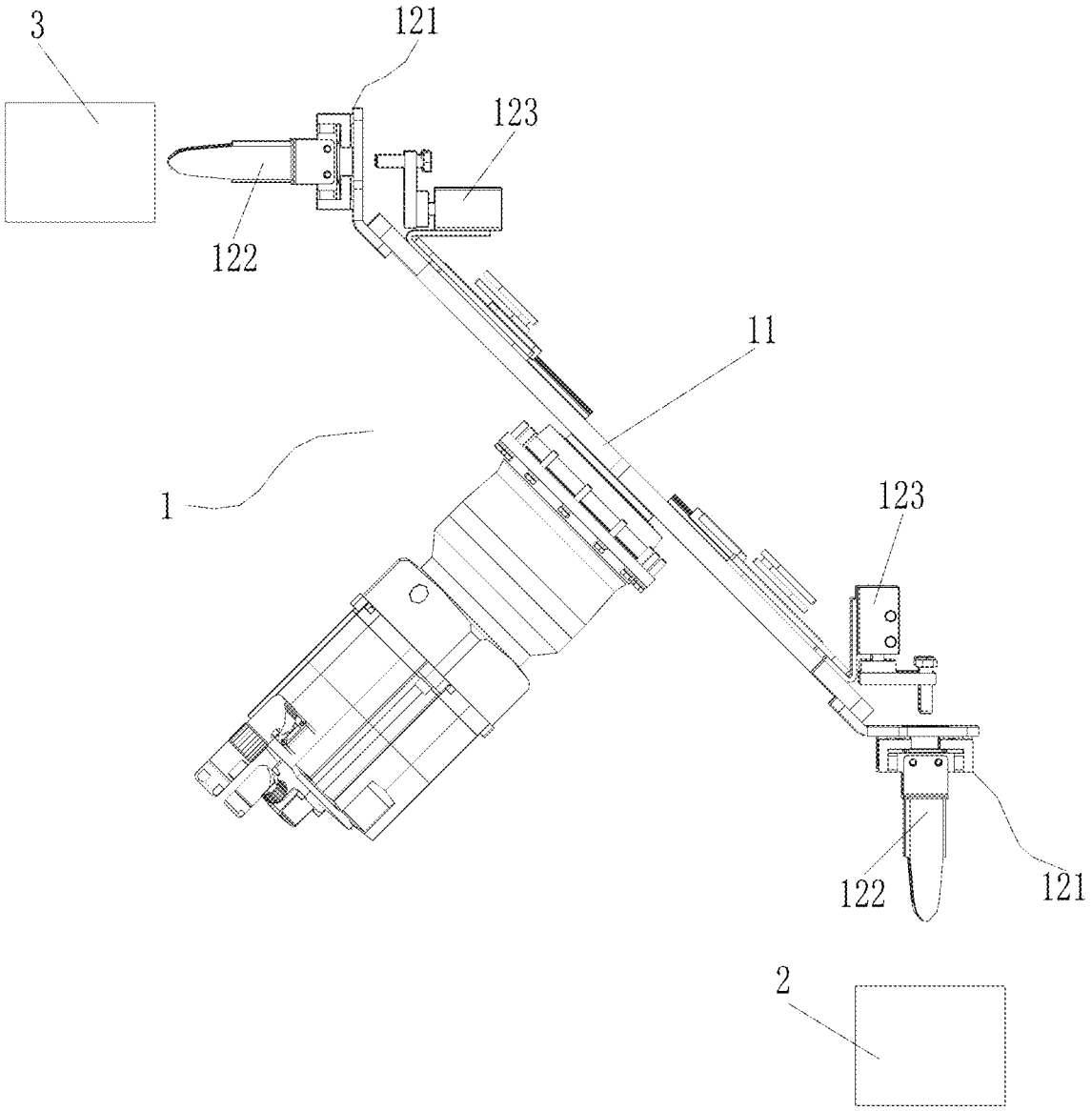
FIG. 17 is a schematic structural view of a packaging machinery according to another embodiment.

In an embodiment, as shown in FIG. 16, an angle between the rotation plane of the rotation base 11 of the conveying mechanism 1 for the packaging machinery and a horizontal plane is 45°. The elastic bag holding mechanism shown in FIG. 1 may still be employed on the station unit 121. Moreover, an angle between the direction of the elastic bag holding mechanism and the rotation plane of the rotation base 11 is 45°. That is, an angle between the direction of the opening portion of the packaging container encasing the elastic bag holding mechanism and the rotation plane of the rotation base 11 is 45°. Preset workstations are arranged at the highest point and the lowest point of the conveying path of the conveying mechanism 1 for the packaging machinery. The preset workstation at the highest point is provided with the packaging container feeding mechanism 2, and the preset workstation at the lowest point is provided with the material filling mechanism 3. The packaging container feeding mechanism 2 loads the packaging container onto the station unit 121 along the horizontal direction, and at this time, the opening portion of the packaging container on the station unit 121 faces in the horizontal direction. The material filling mechanism 3 fills the material into the packaging container on the station unit 121 along the vertical direction, and at this time, the opening portion of the packaging container on the station unit 121 faces in the vertical direction. This structure is suitable for filling of bulk materials. Under the action of gravity, the material falls downwards into the packaging container. Then the packaging container filled with the material gets out of the station unit 121 downwards to be unloaded. Finally, the packaging container is sealed, and the finished product is discharged. Alternatively, as shown in FIG. 17, the preset workstation at the lowest point is provided with the packaging container feeding mechanism 2, and the preset workstation at the highest point is provided with the material filling mechanism 3. The packaging container feeding mechanism 2 loads the packaging container upwards onto the station unit 121 along the vertical direction. The material filling mechanism 3 fills the material into the packaging container on the station unit 121 along the horizontal direction, and pushes the packaging bag filled with the material out of the station unit 121. Finally, the packaging container is sealed and the finished product is discharged.

Figure 18:
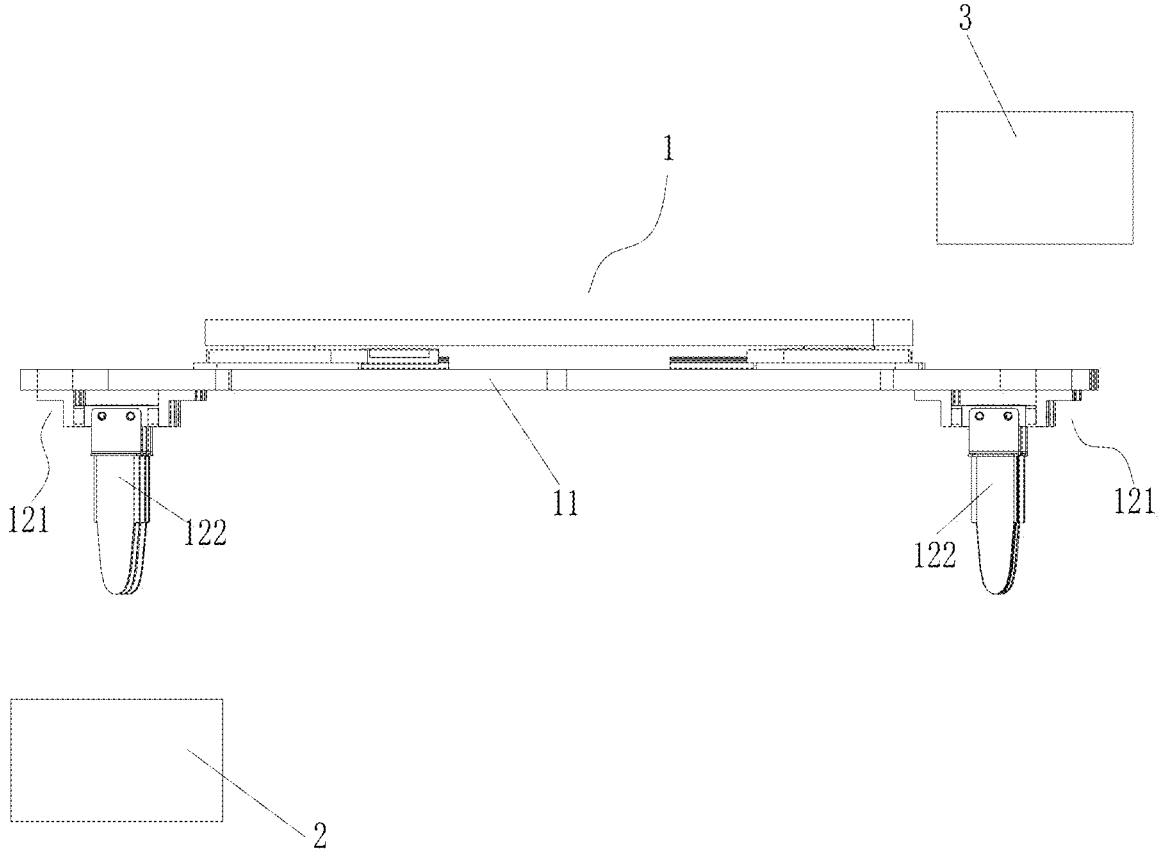
FIG. 18 is a schematic structural view of a packaging machinery according to another embodiment.

In an embodiment, as shown in FIG. 18, the rotation plane of the rotation base 11 of the conveying mechanism 1 for the packaging machinery is along the horizontal direction. The elastic bag holding mechanism shown in FIG. 1 may still be employed on the station unit 121, and the direction of the elastic bag holding mechanism is perpendicular to the rotation plane of the rotation base 11. That is, an angle between the direction of the opening portion of the packaging container encasing the elastic bag holding mechanism and the rotation plane of the rotation base 11 is 90°. Since the rotation plane of the rotation base 11 is along the horizontal direction, the opening portion of the packaging container on the station unit 121 faces upwards along the vertical direction. Preset workstations are respectively arranged at two sides of a diameter of the looped conveying path of the conveying mechanism 1 for the packaging machinery. The preset workstation at one side is provided with the packaging container feeding mechanism 2, and the preset workstation at the other side is provided with the material filling mechanism 3. The packaging container feeding mechanism 2 loads the packaging container upwards onto the station unit 121 along the vertical direction, and the material filling mechanism 3 fills the material downwards into the packaging container on the station unit 121 along the vertical direction. This structure is suitable for filling of bulk materials. Under the action of gravity, the material falls downwards into the packaging container. Then the packaging container filled with the material gets out of the station unit 121 downwards to be unloaded, and finally the packaging container is sealed, and the finished product is discharged.

Figure 19:
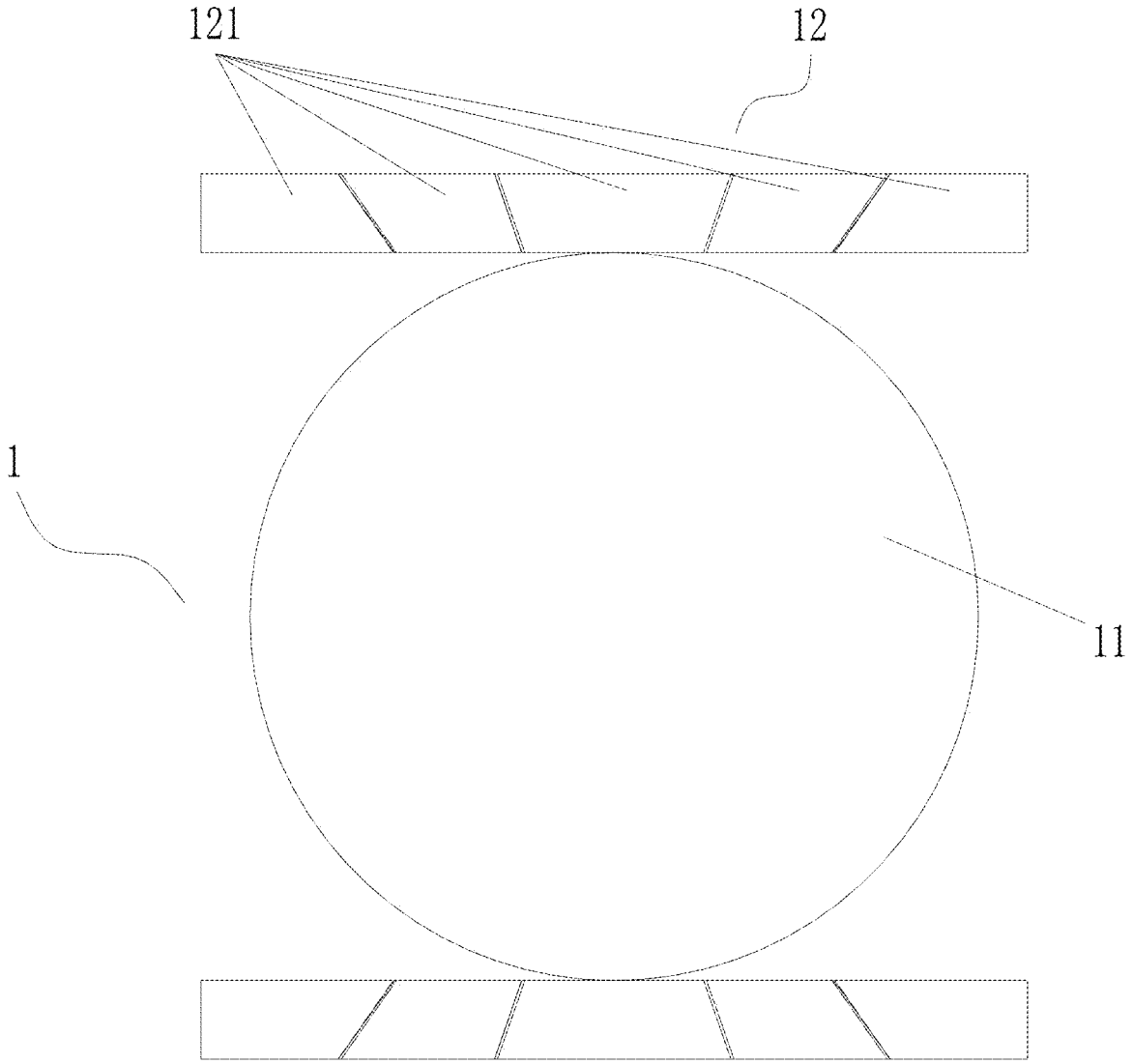
FIG. 19 is a schematic structural view of another packaging machinery conveying mechanism when a station assembly is in an expanded posture.
Figure 20:
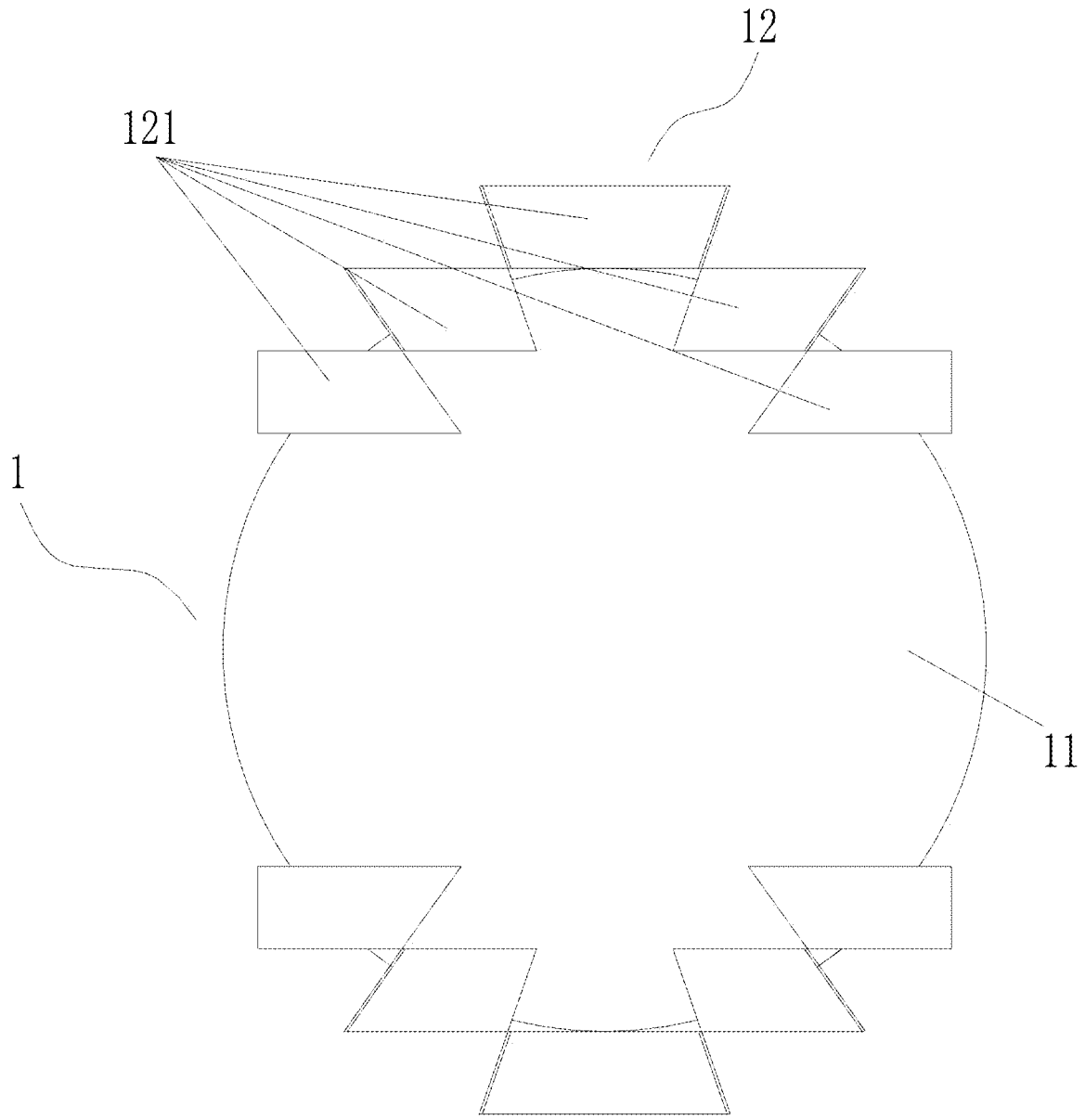
FIG. 20 is a schematic structural view of the conveying mechanism for the packaging machinery shown in FIG. 19 when the station assembly is in a retracted posture.

In an embodiment, as shown in FIG. 19 and FIG. 20, the station units 121 of the station assembly 12 are connected one after another. Every two adjacent station units 121 are connected in a slidable manner, and slide with respect to each other towards an inner side or an outer side of the radial direction of the rotation base 11. The two adjacent station units 121 are driven by the expansion-retraction driving mechanism to slide with respect to each other, so as to make the station assembly 12 switch between the expanded posture and the retracted posture. More specifically, the two adjacent station units 121 slide with respect to each other along a direction parallel to the rotation plane of the rotation base 11, and therefore the station units 121 relatively slide in a plane parallel to the rotation plane of the rotation base 11. That is, the station assembly 12 switches the posture in a plane parallel to the rotation plane of the rotation base 11. Specifically, the two adjacent station units 121 slide with respect to each other along the radial direction of the rotation base 11, or parallel to the radial direction of the rotation base 11, or there is an angle between the sliding direction of the two adjacent station units 121 and the radial direction of the rotation base 11. The station units 121 of the station assembly 12 may be arranged linearly or in a curved manner. Preferably, the station assembly 12 is in the expanded posture when the station units 121 of the station assembly 12 are linearly arranged, so that the mechanism units are arranged in parallel at each operating mechanism to conveniently perform packaging processes on the station units 121. Further, the station units 121 of the station assembly 12 are linearly arranged along the tangential direction of the circumferential direction of the rotation of the rotation base 11. This state facilitates the structural design of the operating mechanism. Correspondingly, the mechanism units of each operating mechanism are linearly arranged in parallel, which is easy to design and implement, and the structure is compact. When the station assembly 12 rotates to the preset workstation and is in the expanded posture where the station units 121 are linearly arranged, the station units 121 are in one-to-one correspondence to the mechanism units of the operating mechanism, such that each mechanism unit performs the packaging process on the corresponding station unit 121. When the station assembly 12 needs to rotate from one preset workstation to a next preset workstation, the station assembly 12 switches to the retracted posture to decrease the radius of gyration. Specifically, the station assembly 12 is in the retracted posture when the station units 121 of the station assembly 12 are arranged along the circumferential direction of the rotation of the rotation base 11. That is, the station units 121, which are linearly arranged along the tangential direction of the circumferential direction of the rotation of the rotation base 11 originally, slide inwards along the radial direction of the rotation base 11, and are finally arranged along the circumferential direction of the rotation of the rotation base 11. In this way, the radius of gyration of the rotating body is effectively decreased, the space required for rotation is reduced, the size of the conveying mechanism 1 for the packaging machinery is reduced, and the moment of inertia is decreased for faster rotation and switching, thereby increasing the efficiency of the packaging process.

Figure 21:
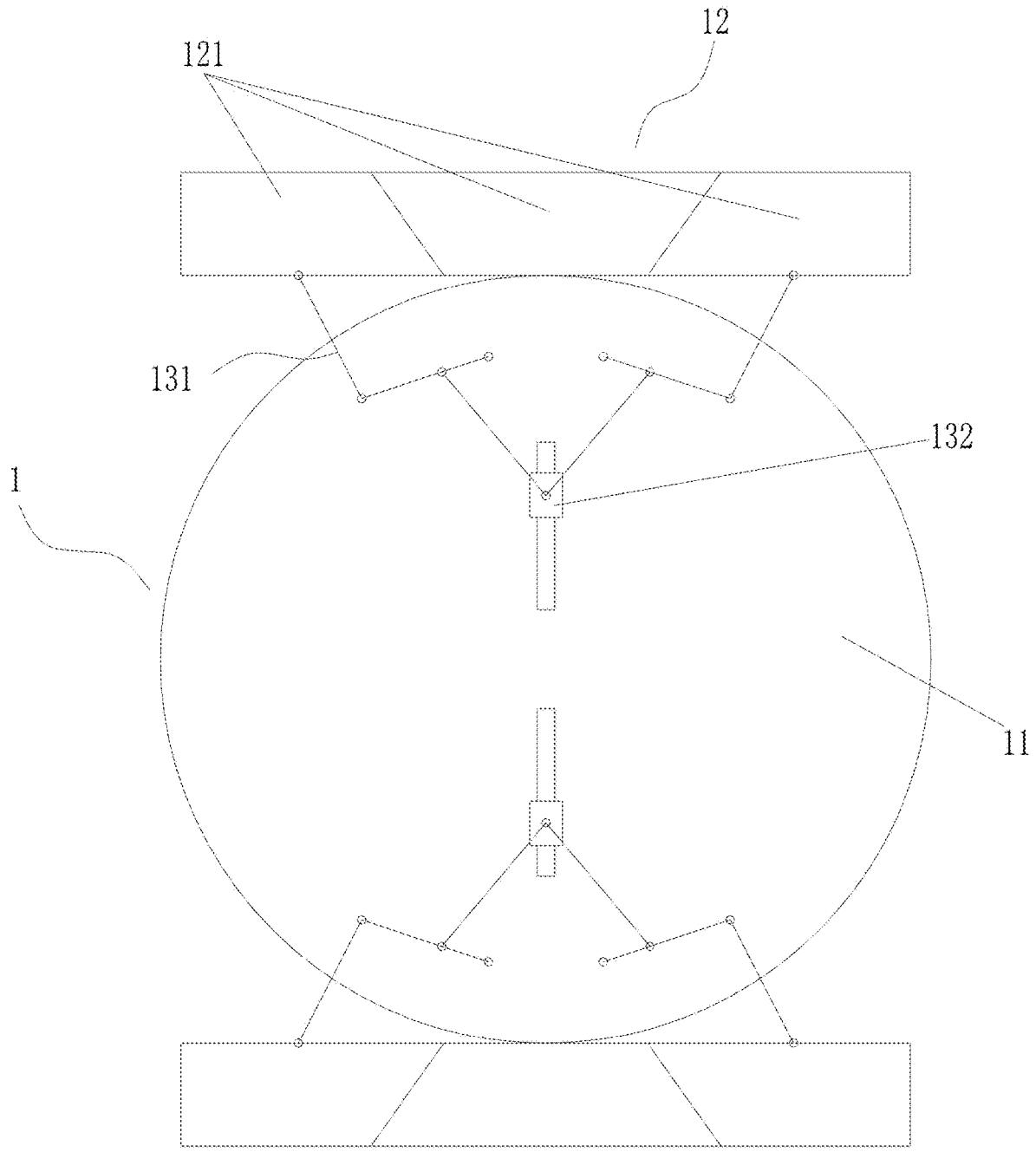
FIG. 21 is a schematic structural view of another conveying mechanism for the packaging machinery.

For the station assembly 12 shown in FIG. 19, the expansion-retraction driving mechanism may be a linear driving mechanism directly provided between every two adjacent station units 121. The linear driving mechanism moves along the sliding direction of the two adjacent station units 121, so that the linear driving mechanism can drive the two adjacent station units 121 to slide with respect to each other, so as to make the station assembly 12 switch between the expanded posture and the retracted posture. The expansion-retraction driving mechanism may employ a structure including a cam guide component 131 and a slider 132, as shown in FIG. 21. The slider is driven by the driving component to move, and further drives the station units 121 to slide with respect to each other through the connecting rod assembly to switch the posture of the station assembly 12. The driving component may specifically be a cam guide component, a linear telescopic driving mechanism or the like.

Apart from the above embodiments, the station units 121 of the station assembly 12 may not be directly connected to each other, as long as the station units 121 can move with respect to each other to change the posture of the station assembly 12. Each station unit 121 may be connected to the rotation base 11 through a corresponding expansion-retraction driving mechanism, and is driven by the corresponding expansion-retraction driving mechanism to move with respect to the rotation base 11, to change the posture of the station assembly 12.

The embodiments hereinabove are only preferred embodiments of the present application. It should be noted that, the above preferred embodiments should not be construed as limitations to the present application, and the scope of protection of the present application is defined by the claims of the present application. For those skilled in the art, a few of modifications and improvements may be made without departing from the spirit and scope of the present application, and these modifications and improvements are also deemed to fall into the scope of protection of the present application.

The invention claimed is:

1. A conveying mechanism for packaging machinery, comprising:

a rotation base;

a station assembly; and an expansion-retraction driving mechanism, wherein a rotation driving mechanism is configured to drive the rotation base to rotate intermittently, and the station assembly is connected to the rotation base;

the station assembly comprises at least two station units for arranging a packaging container, the at least two station units are connected in sequence, every two adjacent station units are directly connected in a movable manner, and the expansion-retraction driving mechanism is configured to drive the two adjacent station units to move relative to each other, to make the station assembly switch between an expanded posture and a retracted posture;

a radius of gyration of the station assembly in the retracted posture is smaller than a radius of gyration of the station assembly in the expanded posture; and wherein each station unit comprises a body and a retaining mechanism for retaining a packaging container, and wherein the retaining mechanism extends substantially perpendicular from the body and at an angle relative to a rotation plane of the rotation base.

2. The conveying mechanism for the packaging machinery according to claim 1, wherein when the station assembly is in the expanded posture, the at least two station units of the station assembly are linearly arranged along a tangential direction of a circumferential direction of rotation of the rotation base; and when the station assembly is in the retracted posture, the at least two station units of the station assembly are arranged along the circumferential direction of the rotation of the rotation base.

3. The conveying mechanism for the packaging machinery according to claim 1, wherein every two adjacent station units are hingedly connected; and the expansion-retraction driving mechanism is configured to drive the two adjacent station units to deflect with respect to each other, to make the station assembly switch between the expanded posture and the retracted posture.

4. The conveying mechanism for the packaging machinery according to claim 3, wherein the at least two station units of the station assembly comprise at least a middle station unit and a side station unit on each side of the middle station unit, and the middle station unit is fixedly connected to the rotation base.

5. The conveying mechanism for the packaging machinery according to claim 3, wherein the expansion-retraction driving mechanism comprises a driving component, a connecting rod assembly, and a slider;

the slider is connected to the rotation base in a slidable manner, and is configured to slide along a radial direction of a circumference of the rotation of the rotation base, and the slider is connected to the at least two station units of the station assembly through the connecting rod assembly; and the driving component is configured to drive the slider to move along the radial direction of the circumference of the rotation of the rotation base, to make the station assembly switch between the expanded posture and the retracted posture.

6. The conveying mechanism for the packaging machinery according to claim 5, wherein the driving component comprises a cam guide component, and the slider is connected to the cam guide component in a slidable manner.

7. The conveying mechanism for the packaging machinery according to claim 5, wherein the driving component comprises a driving member and a pulling rod, and the driving member is connected to the rotation base in a slidable manner, and is configured to slide along a direction perpendicular to the rotation plane of the rotation base; and one end of the pulling rod is hingedly connected to the driving member, and the other end of the pulling rod is hingedly connected to the slider.

8. The conveying mechanism for the packaging machinery according to claim 3, wherein the at least two station units of the station assembly comprise two middle station units and a side station unit on each side of the two middle station units, and the two middle station units are movably connected to the rotation base; or a number of the at least two station units of the station assembly is two, and the two station units are movably connected to the rotation base.

9. The conveying mechanism for the packaging machinery according to claim 1, wherein at least two station assemblies are evenly provided along a circumferential direction of rotation of the rotation base and are spaced apart.

10. The conveying mechanism for the packaging machinery according to claim 1, wherein the retaining mechanism is an elastic bag holding mechanism, the elastic bag holding mechanism comprises a bag holder that elastically is in an expanded state, and the bag holder is configured to extend into a bag-type packaging container to elastically retain the bag-type packaging container in an opened state.

11. The conveying mechanism for the packaging machinery according to claim 10, comprising a releasing push mechanism configured to drive the bag holder to switch to a retracted state, wherein the releasing push mechanism is provided at a preset workstation on a rotation path of the station assembly.

12. The conveying mechanism for the packaging machinery according to claim 10, comprising a releasing push mechanism configured to drive the bag holder to switch to a retracted state, wherein the releasing push mechanism is provided on the at least two station units.

13. The conveying mechanism for the packaging machinery according to claim 1, wherein a rotation plane of the rotation base is along a vertical direction, the at least two station units are configured to receive the packaging container along a horizontal direction, and the packaging container on the at least two station units is configured to receive the material filled along the horizontal direction.

14. The conveying mechanism for the packaging machinery according to claim 1, wherein every two adjacent station units are connected in a slidable manner, and are slidable with respect to each other along a radial direction of the rotation base; and the expansion-retraction driving mechanism is configured to drive the two adjacent station units to slide with respect to each other, to make the station assembly switch between the expanded posture and the retracted posture.

15. The conveying mechanism for the packaging machinery according to claim 1, wherein the rotation plane of the rotation base is along a horizontal direction, the at least two station units are configured to receive the packaging container along a vertical direction, and the packaging container on the at least two station units is configured to receive material filled along the vertical direction; or an angle between the rotation plane of the rotation base and a horizontal plane is 45°, the at least two station units are configured to receive the packaging container along the horizontal direction, and the packaging container on the at least two station units is configured to receive the material filled along the vertical direction, or the at least two station units are configured to receive the packaging container along the vertical direction, and the packaging container on the at least two station units is configured to receive the material filled along the horizontal direction.

16. A packaging machinery, comprising the conveying mechanism for the packaging machinery according to claim 1, wherein each of preset workstations on a conveying path of the conveying mechanism for the packaging machinery is provided with an operating mechanism configured to perform a different packaging process.

17. A packaging machinery, comprising the conveying mechanism for the packaging machinery according to claim 2, wherein each of preset workstations on a conveying path of the conveying mechanism for the packaging machinery is provided with an operating mechanism configured to perform a different packaging process.

18. A packaging machinery, comprising the conveying mechanism for the packaging machinery according to claim 3, wherein each of preset workstations on a conveying path of the conveying mechanism for the packaging machinery is provided with an operating mechanism configured to perform a different packaging process.

19. A packaging machinery, comprising the conveying mechanism for the packaging machinery according to claim 4, wherein each of preset workstations on a conveying path of the conveying mechanism for the packaging machinery is provided with an operating mechanism configured to perform a different packaging process.

* * * * *